US008443633B1

(12) United States Patent
Inli

(10) Patent No.: US 8,443,633 B1
(45) Date of Patent: May 21, 2013

(54) APPARATUS AND METHOD FOR TRANSFERRING LOOPS FROM THE KNITTING MACHINE NEEDLE

(75) Inventor: Mustafa Inli, Kadikoy Istanbul (TR)

(73) Assignee: Da Kong Enterprise Co., Ltd., Changhua (TW)

( * ) Notice: Subject to any disclaimer, the term of this patent is extended or adjusted under 35 U.S.C. 154(b) by 0 days.

(21) Appl. No.: 13/603,648

(22) Filed: Sep. 5, 2012

(51) Int. Cl.
*D04B 9/56* (2006.01)

(52) U.S. Cl.
USPC ..... 66/148

(58) Field of Classification Search
USPC ..... 66/148, 147, 149 R, 150, 152, 153, 66/8, 14, 17, 18, 13
See application file for complete search history.

(56) References Cited

U.S. PATENT DOCUMENTS

| | | | | |
|---|---|---|---|---|
| 5,487,281 | A | 1/1996 | Frullini et al. | |
| 5,551,260 | A * | 9/1996 | Frullini et al. | 66/148 |
| 5,570,591 | A * | 11/1996 | Frullini et al. | 66/58 |
| 5,586,453 | A * | 12/1996 | Frullini et al. | 66/148 |
| 6,044,668 | A * | 4/2000 | Conti | 66/148 |
| 6,105,399 | A * | 8/2000 | Frullini et al. | 66/148 |
| 6,155,081 | A * | 12/2000 | Frullini et al. | 66/58 |
| 6,164,091 | A * | 12/2000 | Frullini et al. | 66/148 |
| 6,826,930 | B2 * | 12/2004 | Frullini et al. | 66/148 |
| 7,107,797 | B2 * | 9/2006 | Frullini et al. | 66/148 |
| 8,028,546 | B2 * | 10/2011 | Lonati et al. | 66/148 |
| 2001/0039816 | A1 * | 11/2001 | Fujiwara et al. | 66/13 |
| 2004/0211226 | A1 | 10/2004 | Frullini et al. | |

FOREIGN PATENT DOCUMENTS

| | | |
|---|---|---|
| EP | 2 080 827 | 7/2009 |
| JP | 2001-316959 | 11/2001 |
| JP | 2004-143614 | 5/2004 |

* cited by examiner

*Primary Examiner* — Danny Worrell
(74) *Attorney, Agent, or Firm* — Morgan, Lewis & Bockius LLP

(57) ABSTRACT

A transfer apparatus for transferring a stocking from a knitting machine to a stitching apparatus to close an open-end of the stocking includes strip and transfer members. The knitting machine includes a needle having a hook for forming a loop at the open-end of the stocking, and a latch to move to or away from the hook. The strip member is movable axially upward and downward and radially towards and away from the needle, and is capable of contacting the loop on the needle to push the loop toward or away from the hook. The transfer member is disposed horizontally above the strip member, is movable axially upward and downward and radially toward and away from the needle, and includes a tip region for receiving the loop from the hook when the strip member pushes the loop to the hook.

20 Claims, 46 Drawing Sheets

APPARATUS AND METHOD FOR TRANSFERRING LOOPS FROM THE KNITTING MACHINE NEEDLE

BACKGROUND OF THE INVENTION

1. Field of the Invention

This invention relates to an apparatus and method for transferring loops from any kind of knitting machine needle, and particularly for use in the stocking machines with toe closure.

2. Description of the Related Art

The toe parts of the stockings manufactured in stocking machines are generally formed in an open state by a first machine. The toe parts of the stockings are manufactured in another machine.

Conventional stocking machines are circular knitting machines that typically have difficulty performing the toe closure process. Once the stocking has been knitted, the toe of the stocking must be stitched using another apparatus. In order to take the stocking from the stocking machine to an external machine for stitching, it is necessary to separately take and transfer the loops from the needles of the machine to the toe stitching apparatus.

This invention proposes an apparatus for taking and transferring the stockings loop by loop from the stocking knitting machines to the toe stitching apparatus. The apparatus according to the invention is also capable of enabling the stocking taken from the knitting machine to be attached loop by loop on the toe stitching apparatus.

In the stocking knitting machines, the needles placed into a plurality of channels opened on the outer longitudinal lateral surface of a cylindrical needle carrier move relative to the needle carrier along the direction of the needle axis. The loop held by the hook located at the upper end of the needle passes through the preceding loop through the upward-downward movement along the needle axis, thereby forming the knots that constitute the knit. The manufacture of the stocking in a stocking machine is carried out by knitting in sequential order the leg, heel, sole and toe, beginning from the ribbing.

In order to take the stocking loop by loop from the stocking machine and to attach the same to the toe stitching apparatus for stitching the toe part of the stocking, the machine is stopped while the last loops of at the end of the toe of the stocking being knitted are attached to the hooks of the needles.

Some solutions have been proposed for separately taking, through a transfer member, the loops attached to the needle hooks and for separately transferring the same to the teeth of the reed of the stocking toe stitching apparatus.

For example, in US 2004/211226, the transfer member takes the loop in a position between the needle hook and the latch, but it has to be adjusted very precisely. Even with the smallest maladjustment, it ladders the loop, thus causing the stocking to become defective.

The hook designed according to document no. EP2080827 enters the loop from the side of the needle, thereby taking the loop. Said hook collapses in the shape of a semicircle to perform the transfer to other needles.

In document nos. JP 2004143614 and JP 2001316959, a transfer member comprised by two parts is designed. However, said transfer member is not able to transfer the loops to another reed tooth.

SUMMARY OF THE INVENTION

Therefore, the object of the present invention is to enable the toe sections of the stockings, manufactured in a stocking knitting machine with open toe sections, to be effectively transferred so that they may be stitched in another machine.

Said object is achieved by individually taking the toe loops from the knitting machine needles and individually attaching the same to the reed teeth of a stocking toe stitching apparatus.

According to one aspect of this invention, a transfer apparatus is used for transferring a stocking from a knitting machine to a stitching apparatus to close an open-end of the stocking. The knitting machine includes a needle extending vertically and axially and having a hook for forming a loop at the open-end of the stocking, and a latch that is pivotal upward and downward to move to or away from the hook. The transfer apparatus comprises a strip member and a transfer member. The strip member extends horizontally, and is movable axially upward and downward and radially towards and away from the needle. The strip member is capable of contacting the loop on the needle to push the loop toward or away from the hook. The transfer member is disposed horizontally above the strip member, and is movable axially upward and downward and radially toward and away from the needle. The transfer member includes a tip region for receiving the loop from the hook when the strip member pushes the loop to the hook.

According to another aspect of this invention, a method is used for transferring an open-end of a stocking from a knitting machine to a stitching apparatus. The knitting machine includes a needle which extends vertically and axially and which has a hook to form a loop at the open-end of the stocking, and a latch that is pivotal upward and downward to move to or away from the hook. The method comprises the steps of: moving a strip member towards the needle to contact the loop on the needle from above and to slide downward the loop from the hook until the loop passes the latch; moving the strip member away from the needle after the loop has passed the latch of the needle; moving the strip member toward the needle once again to contact the loop from below and to slide the loop upward and toward the hook; moving a transfer member disposed above the strip member until the transfer member reaches the hook and until the hook extends into a tip region of the transfer member; and moving the strip member further upward to push and transfer the loop from the hook to the transfer member.

The apparatus according to the present invention is preferably applicable to circular knitting machines.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Although the detailed description and the drawings for a transfer apparatus (100) according to the present invention exemplify the application in a circular stocking machine (5), the proposed apparatus may also be implemented in other circular knitting machines.

Knitting machines are circular type knitting machines and according to their general operating principle, the needles placed into a plurality of channels opening longitudinally on the outer surface of a cylindrical needle carrier move relative to the needle carrier along the direction of the needle axis. The loop held by the hook located at the upper end of the needle passes through the preceding loop through the upward-downward movement along the needle axis, thereby forming the knots that constitute the knit.

The stocking is formed by knitting in sequential order the leg, heel, sole and toe, beginning from the ribbing. After the toe section has been knitted as the last step, the stocking is removed from the machine. However, the toe of the stocking remains non-stitched in this condition. The stockings leave the stocking machine (5) with the toe part left open, and the toes of the stockings are stitched later in a different machine.

A certain number of knitting machine needles are arranged along the circumference of the cylinder of the stocking machine. Although two such needles (3) arranged opposite one another have been illustrated in the description of the present invention, the transfer apparatus (100) according to this invention is applicable to all the remaining needles available in the cylinder, and the movement of all the needles in the cylinder may occur simultaneously. The stocking machine (5) is stopped while the last loops, which belong to the stocking being knitted and having the ribbing, leg, heel and toe completed, are attached to the hooks of the needles. In order to enable the stocking machine (5) to form the stocking (4), the transfer apparatus (100), like the upper cylinder or the crimping apparatus located in the top part of the cylinder, is separated from the top section of the stocking machine (5)

throughout the period during which the transfer is being completed, thereby permitting the stocking (4) to be taken from the machine (5).

In single-cylinder stocking machines, the crimping apparatus is in the top section of the cylinder. Double-cylinder machines include an upper cylinder.

In order for the stocking to be taken from above the stocking machine (5), the part located in the top section must be separated from the machine (5) during the transfer. Once the transfer has been completed, the separated part returns to its position and continues manufacturing stockings.

Figure 1:
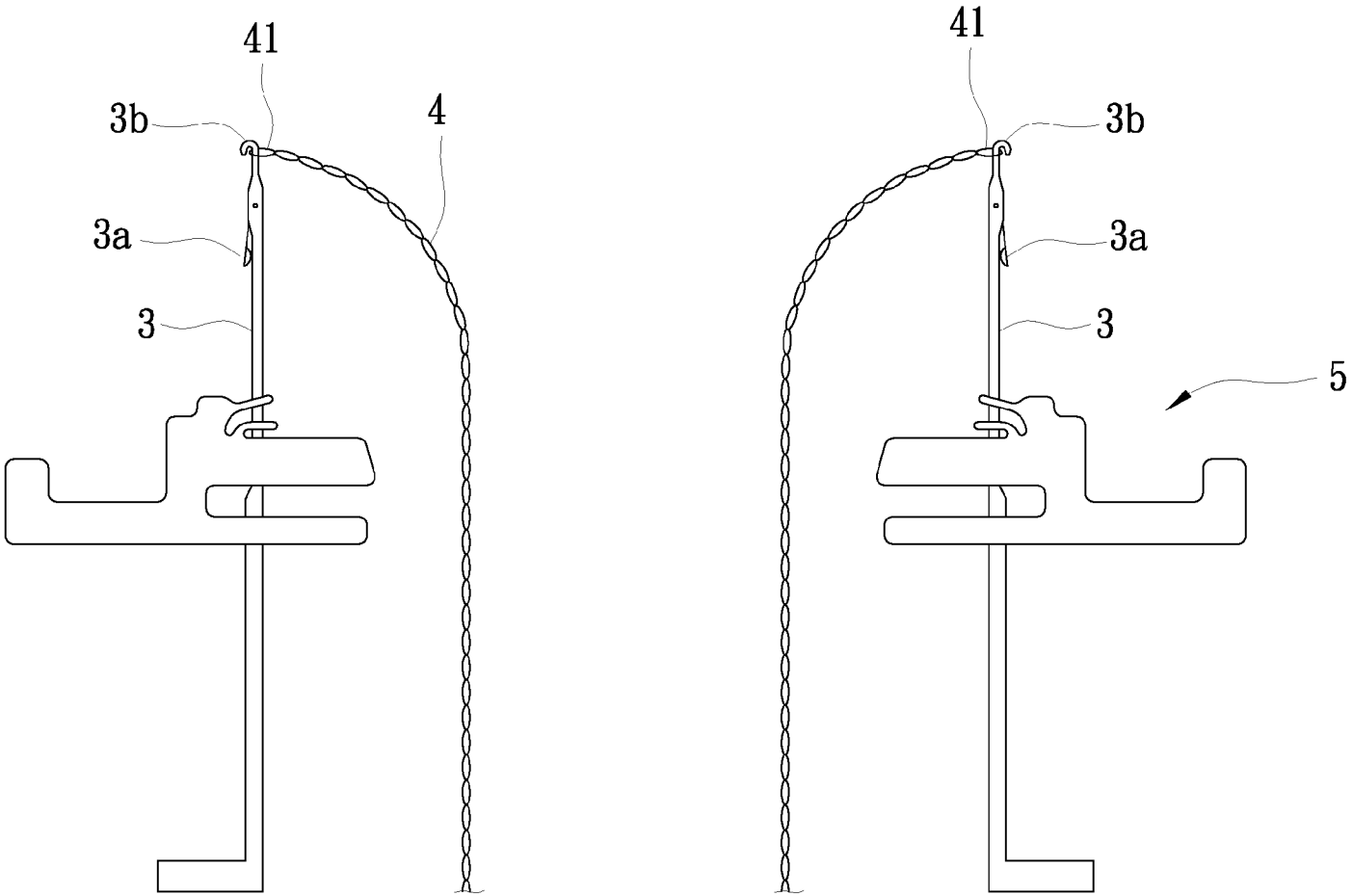
FIG. 1 is a view of the loops at an open-end of the stocking attached to needle hooks of the stocking machine.
Figure 2:
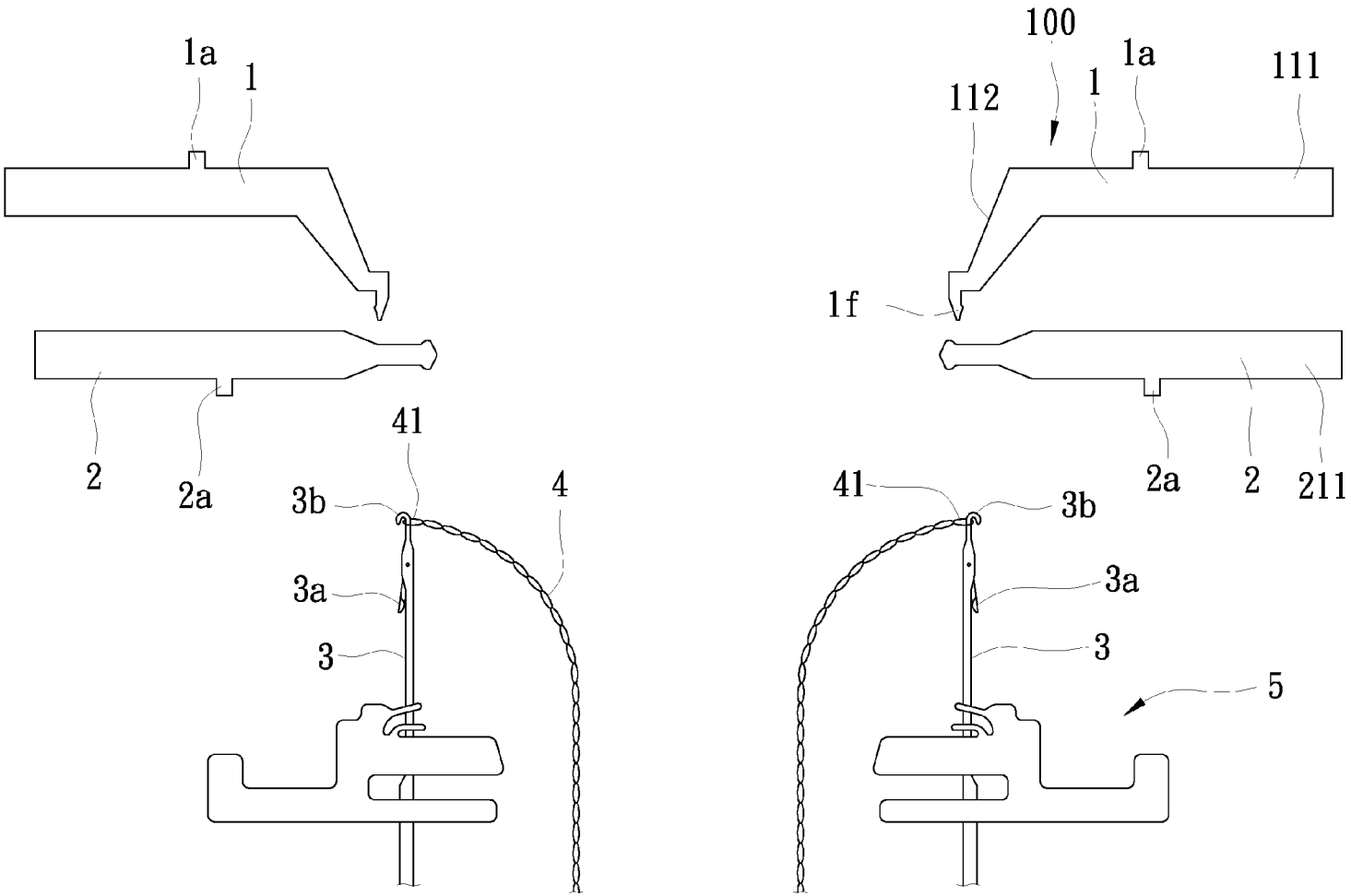
FIG. 2 shows the position assumed by a transfer apparatus of the present invention to perform the transfer on the stocking machine.

In FIGS. 1 and 2, a top side of the stocking machine (5) is opened to enable the transfer apparatus (100) that will carry out the transfer to assume its position on the machine (5). The stocking's (4) last loops (41), which are circular and located at an upper open end of the stocking (4), are held in circular position by hooks (3*b*) of the needles (3). When the knitting is completed, latches (3*a*) of the needles (3) that close the respective hooks (3*b*) during operation are open.

Figure 39:
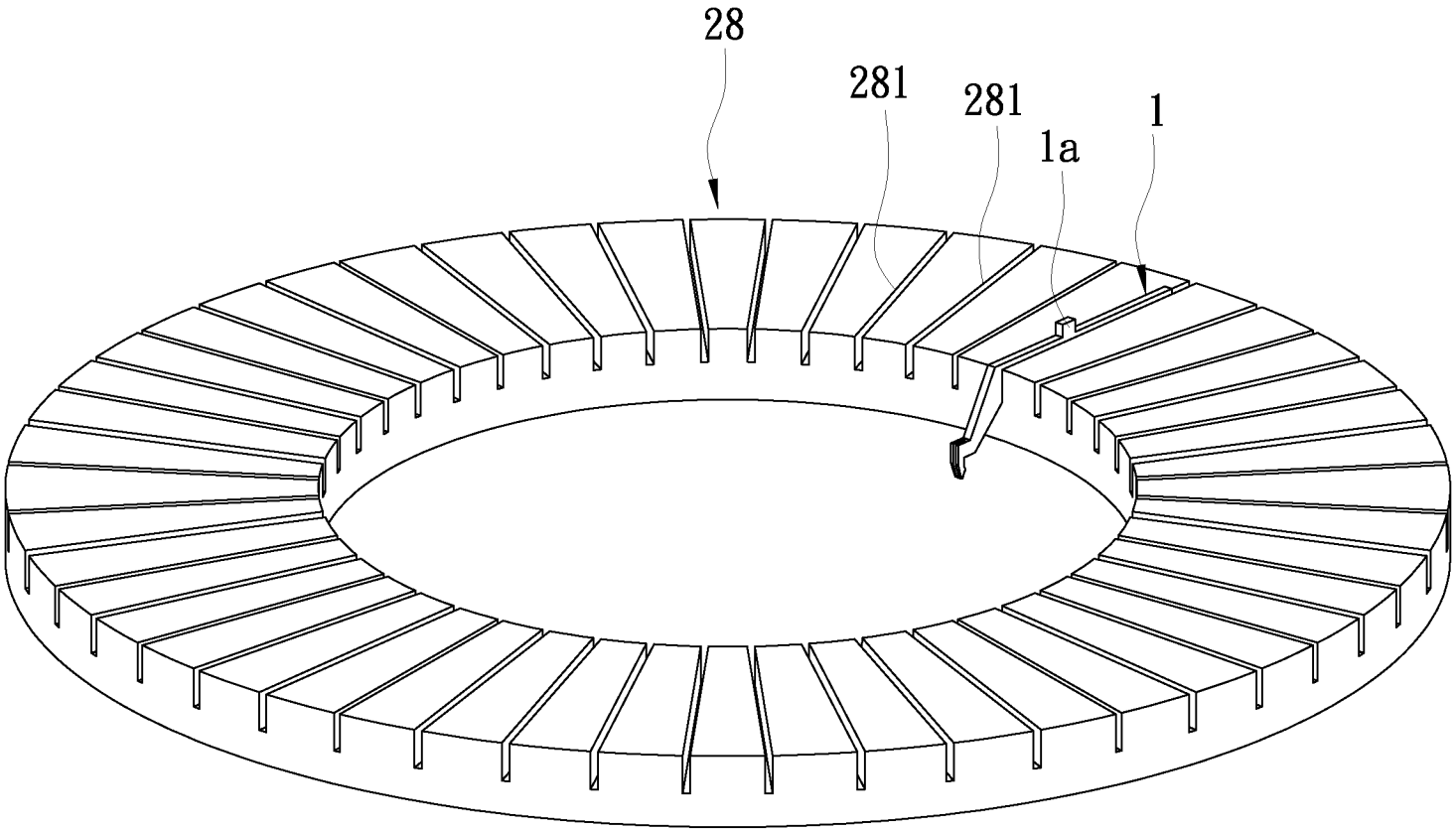
FIG. 39 shows a perspective view of a transfer member bearing that belongs to the transfer member.
Figure 40:
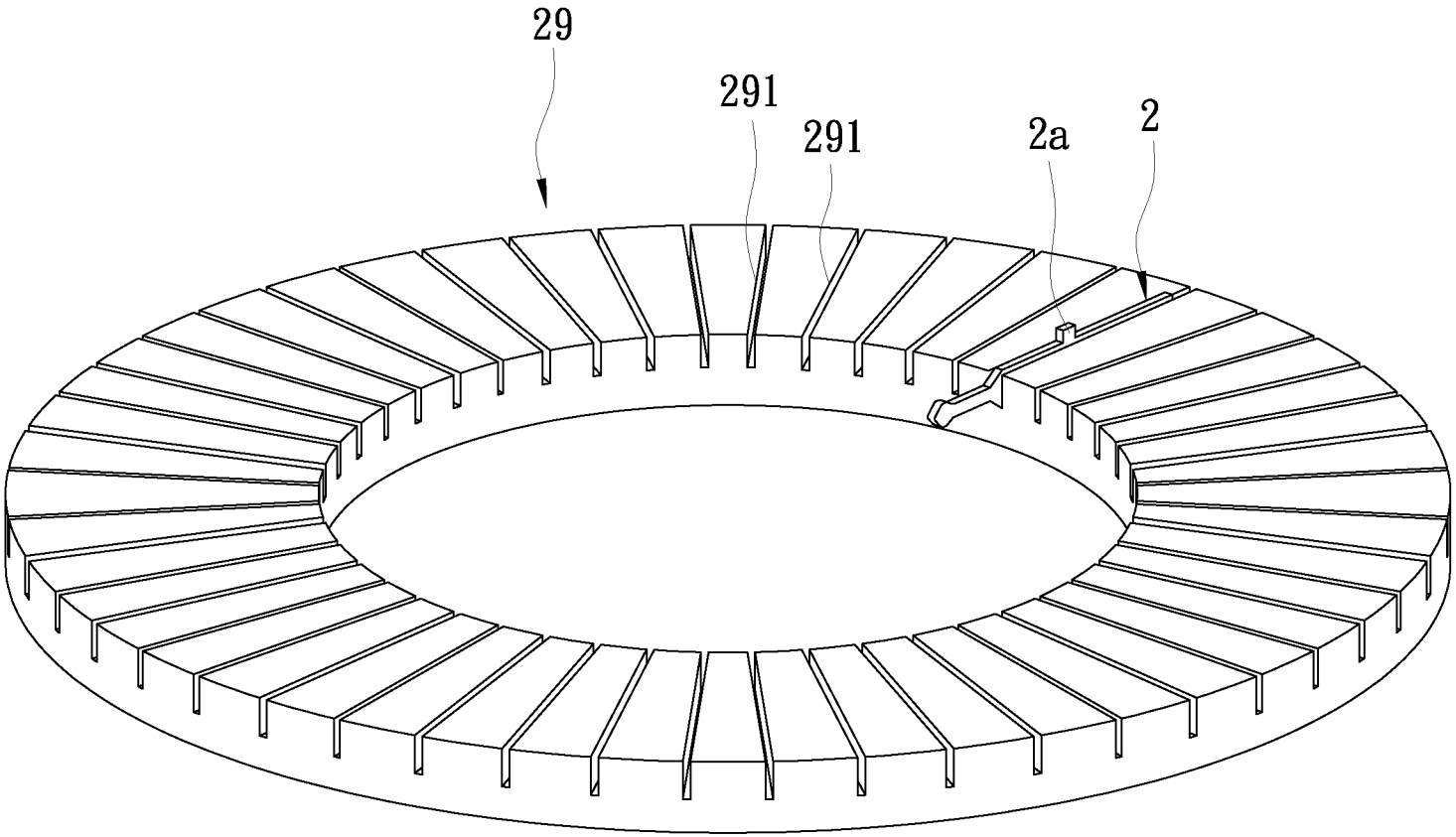
FIG. 40 shows a perspective view of a strip member bearing that belongs to the strip member.

As shown in FIG. 2, the transfer apparatus (100), comprising a plurality of transfer members (1) and a plurality of strip members (2), is positioned on the stocking machine (5) whose top side has been opened. On the transfer apparatus (100), the transfer members (1) which are circularly positioned on a transfer member bearing (28) (see FIG. 39) and the strip members (2) which are positioned on a circular strip member bearing (29) (see FIG. 40) are present in a quantity corresponding to the number of the needles (3) in the stocking machine (5). The transfer member bearing (28) has radial channels (281) that are spaced annularly. The transfer members (1) are disposed slidably and respectively in the radial channels (281). The strip member bearing (29) has radial channels (291) that are spaced annularly. The strip members (2) are disposed slidably and respectively in the radial channels (291).

Figure 31:
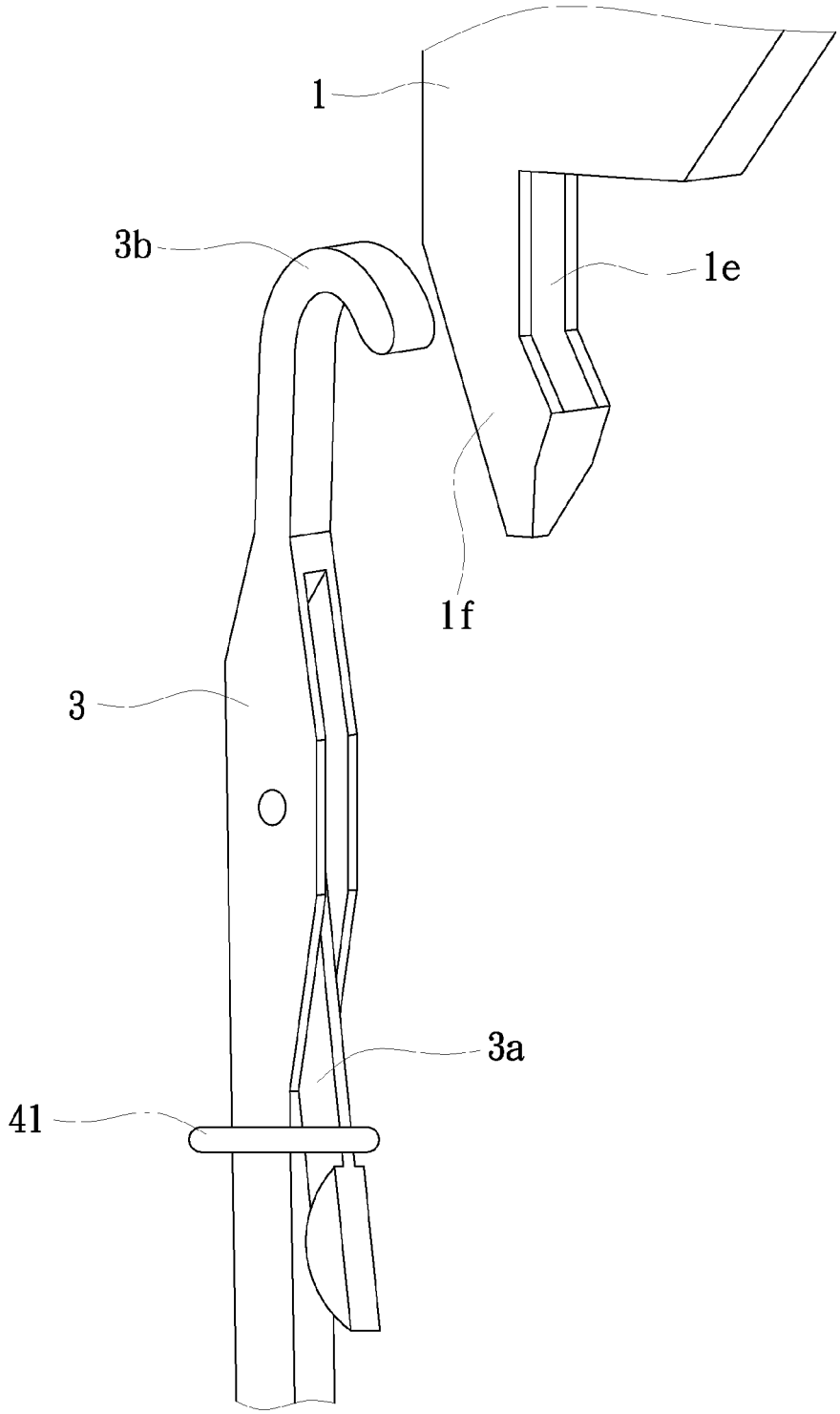
FIG. 31 shows a perspective view of the positioning of the needle for the entry thereof into the transfer member.
Figure 41:
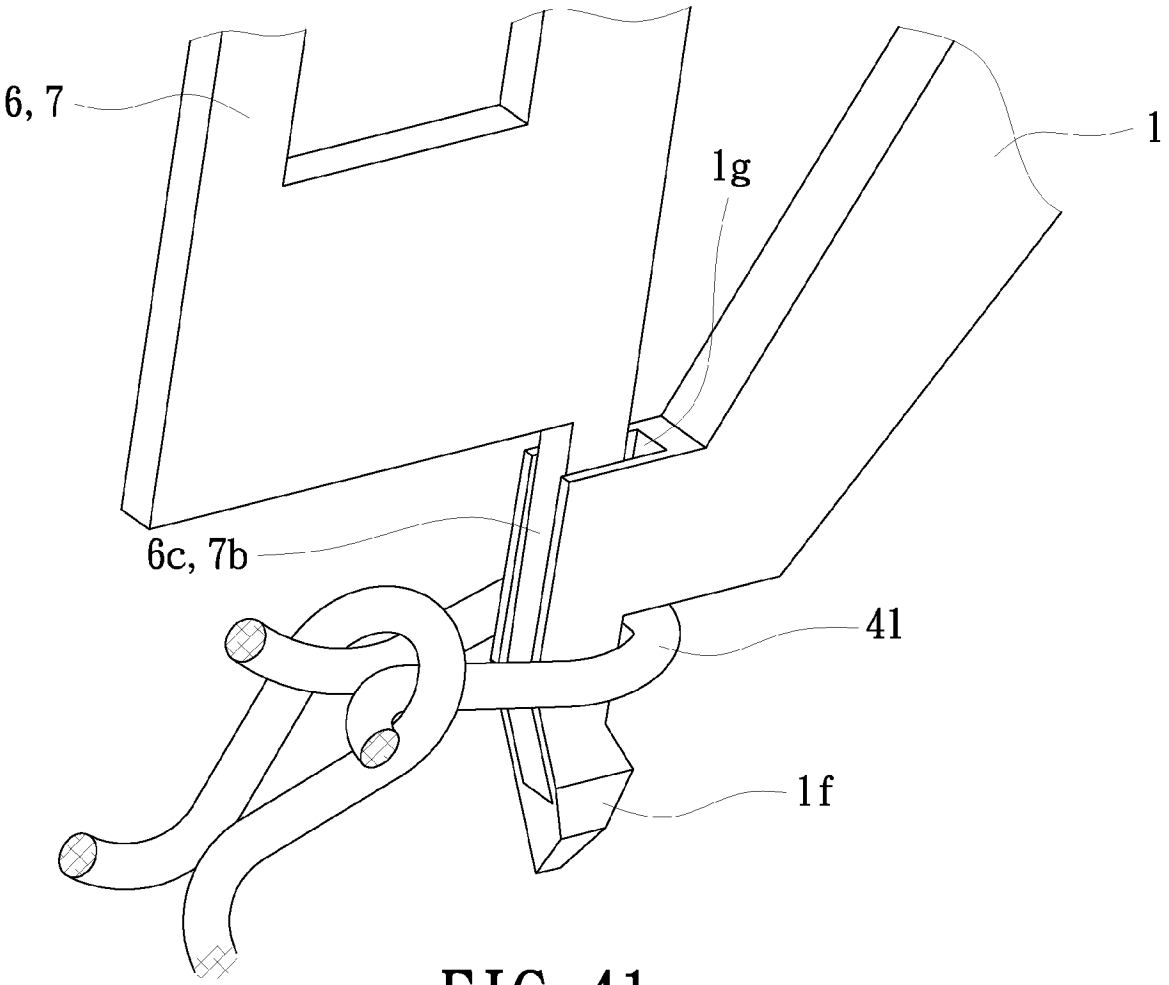
FIG. 41 shows the entry of the transfer member into the tooth of the reed.

Each of the transfer and strip members (1, 2) extends horizontally, and is movable axially upward and downward and radially towards and away from a respective needle (3). Each transfer member (1) is disposed horizontally above the strip member (2), and includes a radial shank portion (111), a front tip (1*f*) opposite the shank portion (111), and a tip region (112) extending inclinedly and downward from the shank portion (111) to the front tip (1*f*) and bending radially and thereafter axially and downward at the front tip (1*f*). The front tip (1*f*) is hollow, and has a substantially inverted L-shaped, a front side formed with a front opening (1*e*) (see FIGS. 31 and 32), and a top side formed with a top opening (1*g*) (see FIG. 41) communicating with the front opening (1*e*). The front opening (1*e*) is disposed at a location where the tip region (112) bends axially and downward to face the needle (3). The top opening (1*g*) is at a location where the tip region (112) bends radially. Each strip member (2) is capable of contacting the loop (41) formed on the hook (3*b*) of the respective needle (3) to push the loop (41) toward or away from the hook (3*b*).

Each of the transfer and strip members (1, 2) has an axially protruding tail (1*a*, 1*b*, 1*c*, 1*d*, 2*a*, 2*b*, 2*c*, 2*d*) extending upward from the respective shank (111, 121). The tails (1*a*-1*d*, 2*a*-2*d*), as will be described in the following, are intended to enable the forward-backward movement of the transfer and strip members (1, 2) according to a radial orientation. The forward-backward movement is provided by a cam mechanism (30). The radial forward-backward (opening-closing) movements take place together simultaneously. For instance, as a transfer member (1) approaches the needle (3), all the other transfer members (1) will approach to the same extent. Similarly, as a strip member (2) begins to enter between two needles (3), all the other strip members (2) will enter between the same number of the needles (3). While each transfer member (1) is positioned exactly opposite each needle (3), each strip member (2) is positioned such that it corresponds to a midpoint between two needles (3).

Figure 3:
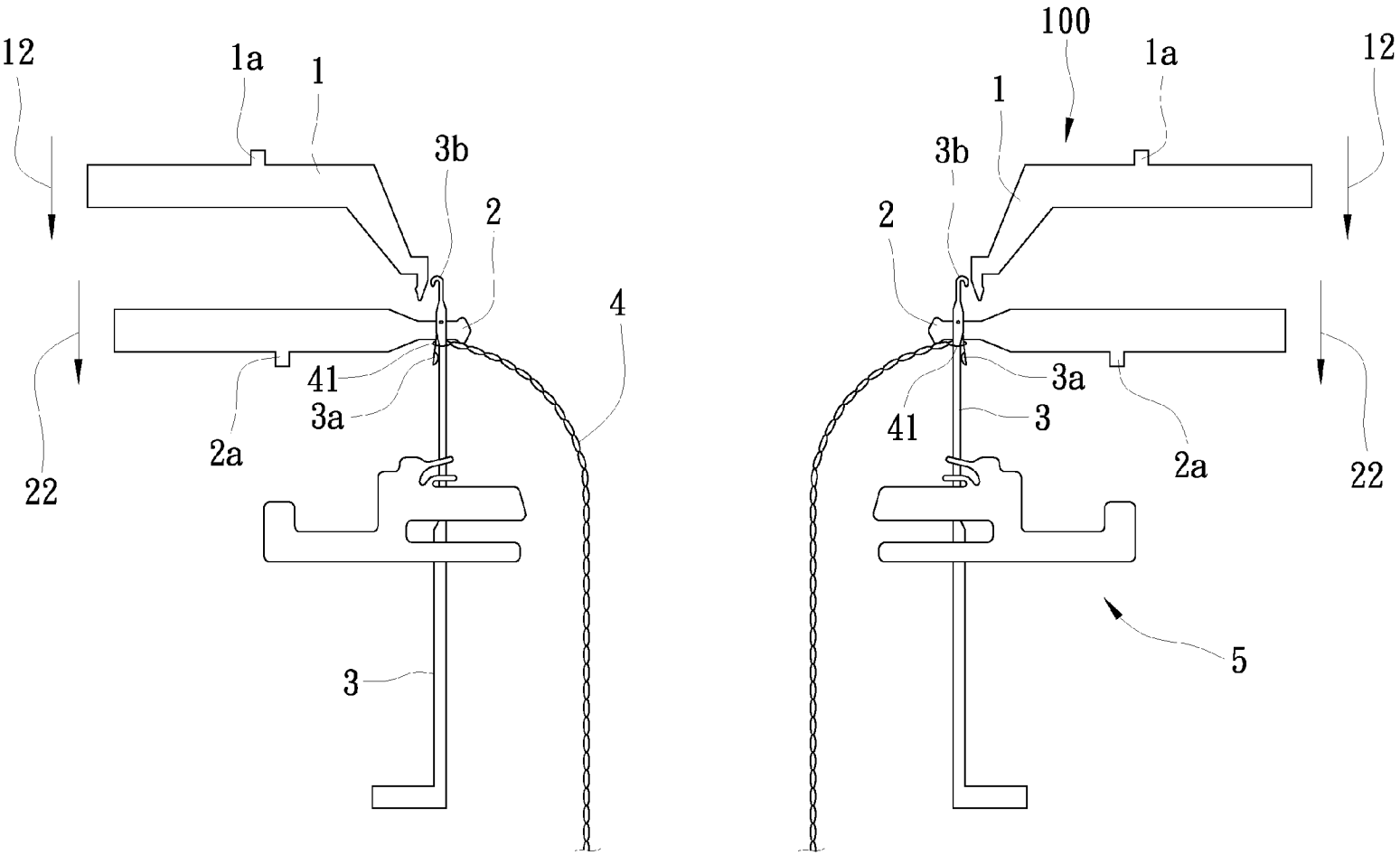
FIG. 3 is a view of the downward movement of the transfer apparatus.

As shown in FIG. 3, first the transfer members (1) and the strip members (2) are moved downward in the direction of arrows (12) and (22), respectively, over a certain distance such that the strip members (2) can contact the loops (41) on the respective needles (3) from above. The strip members (2) then strip down the loops (41) from the respective hooks (3*b*) to such extent that the loops (41) will not drop off from the respective latches (3*a*). In this condition, the latches (3*a*) are completely opened, but the loops (41) have remained on the latches (3*a*). If the loops (41) are stripped down further, the latches (3*a*) will be emptied and some latches (3*a*) could be closed. In case the latches (3*a*) are closed, the transfer members (1) will not be able to assume its position inside the hooks (3*b*). Moreover, this condition will cause the fracture of the latches (3*a*) or of the transfer members (1).

Figure 4:
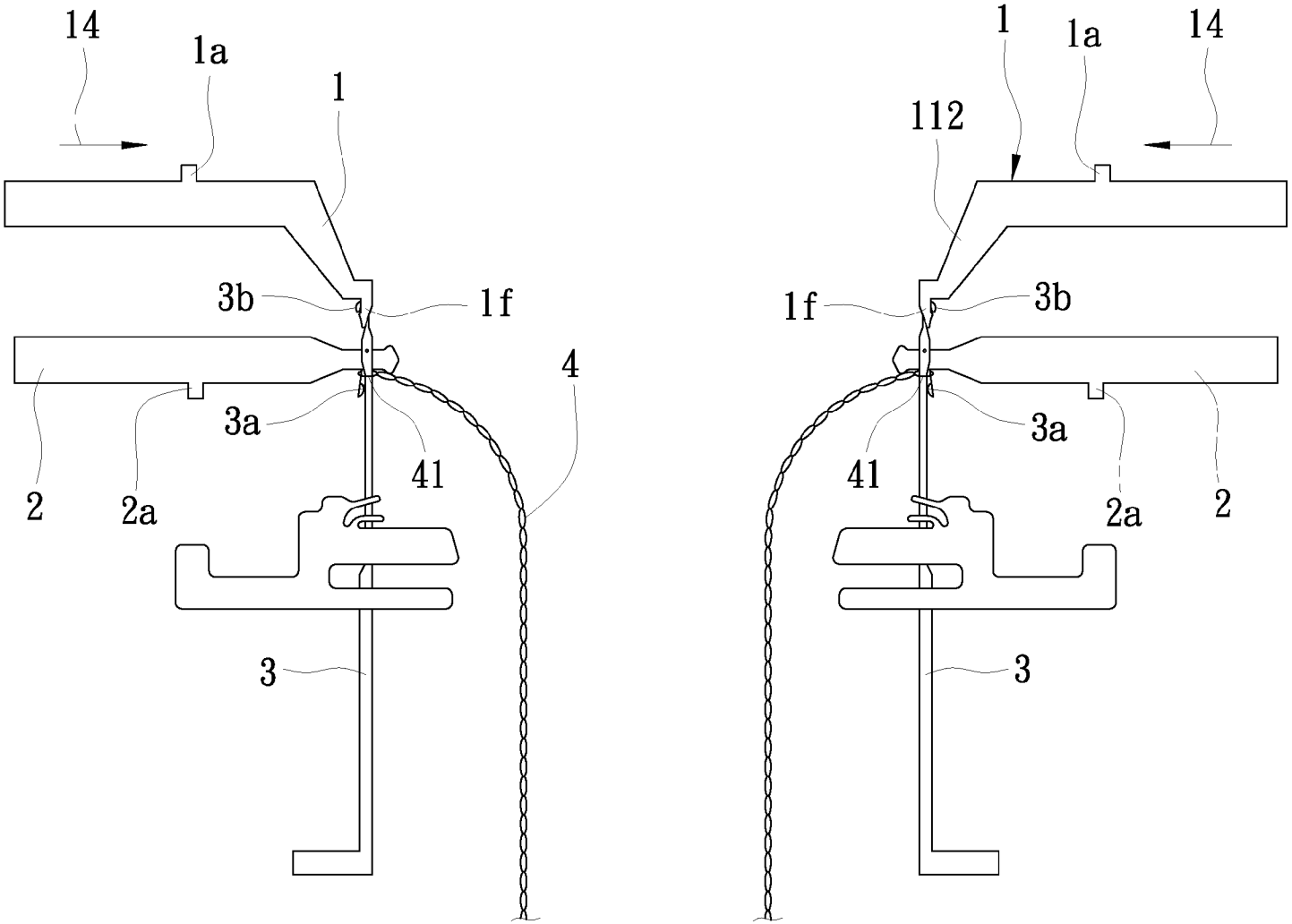
FIG. 4 is a view of the closing of transfer members of the transfer apparatus towards the respective needles.
Figure 5:
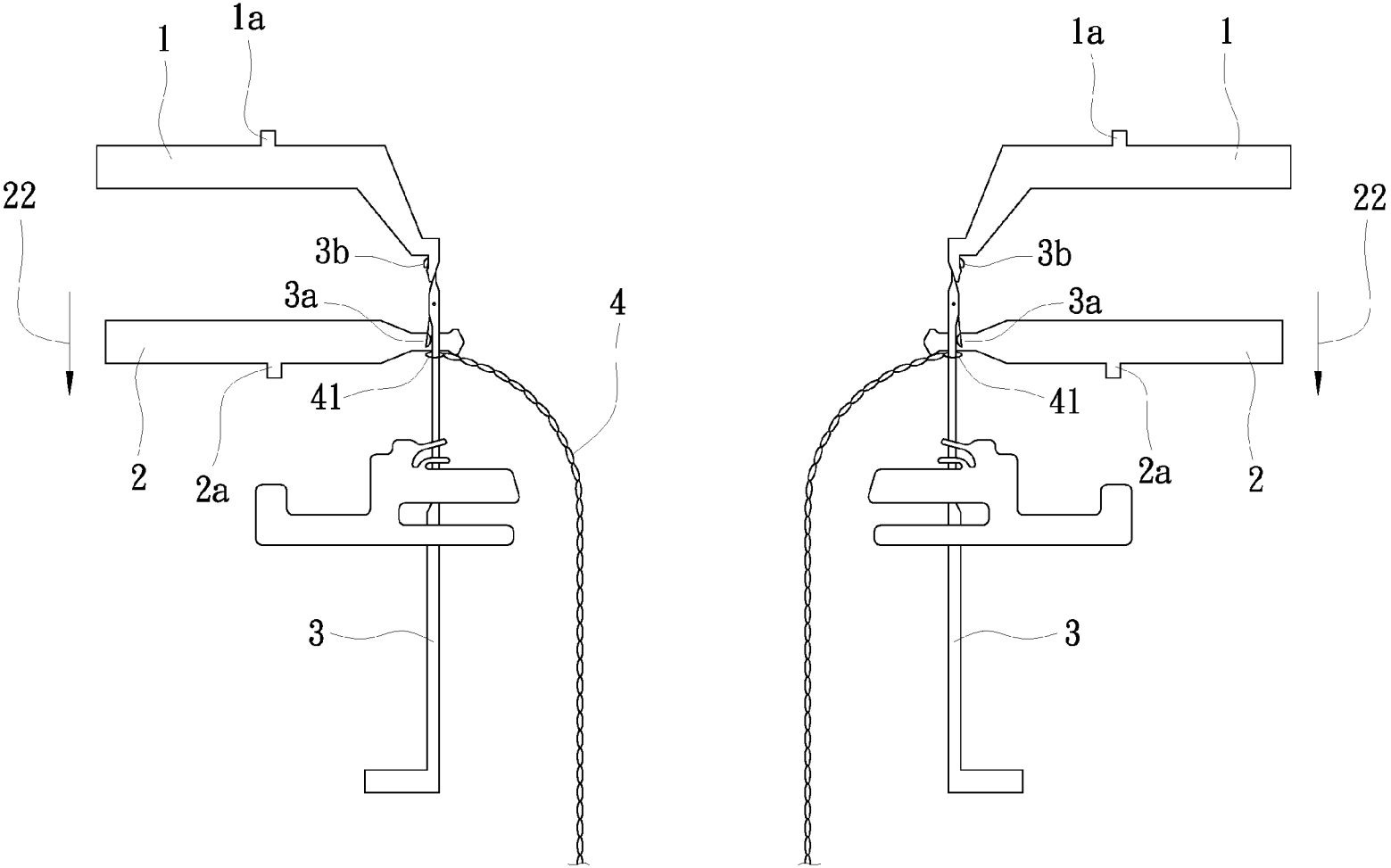
FIG. 5 shows the downward movement of strip members of the transfer apparatus.
Figure 6:
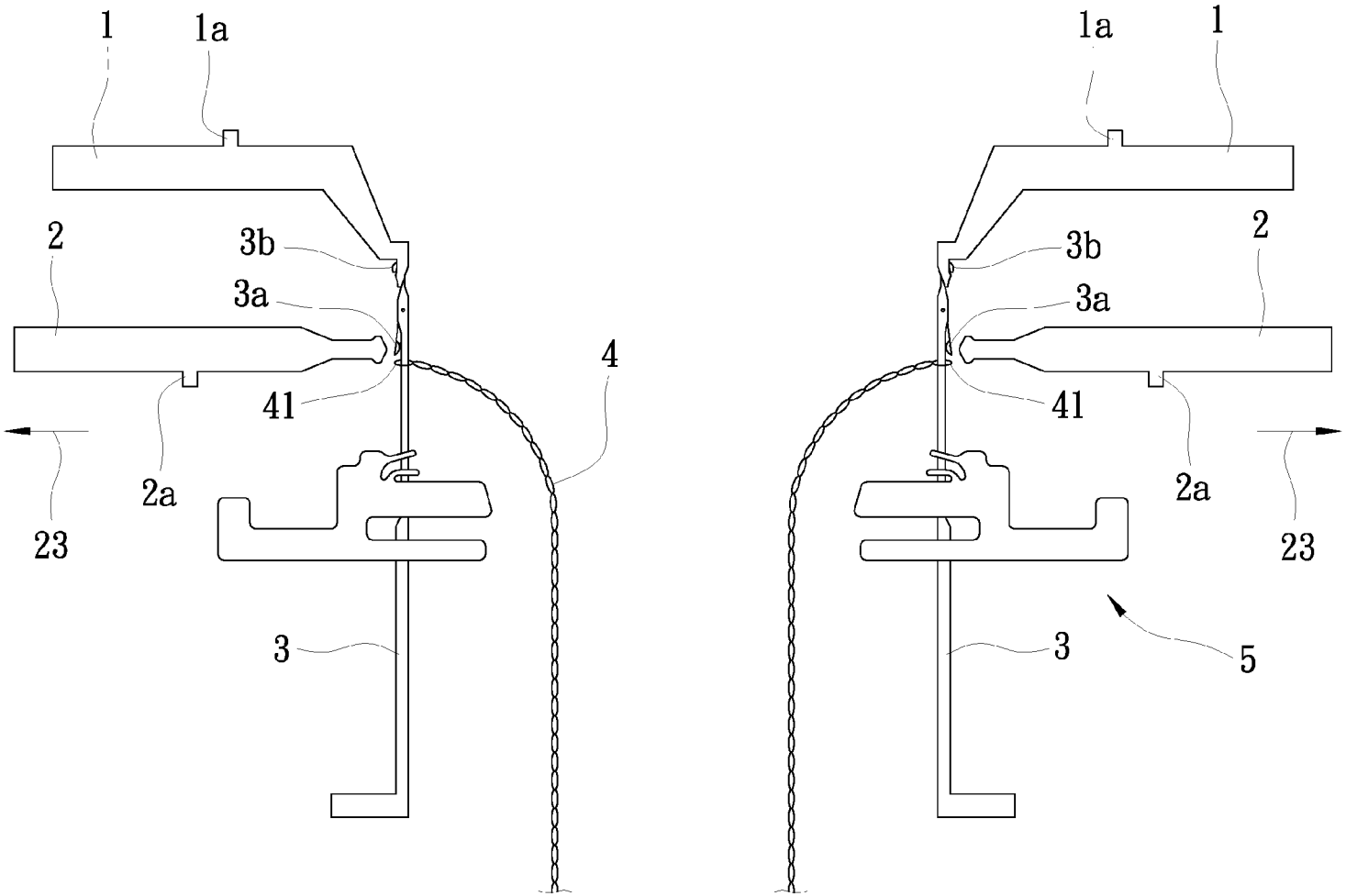
FIG. 6 illustrates the strip members moving away from the respective needles.
Figure 7:
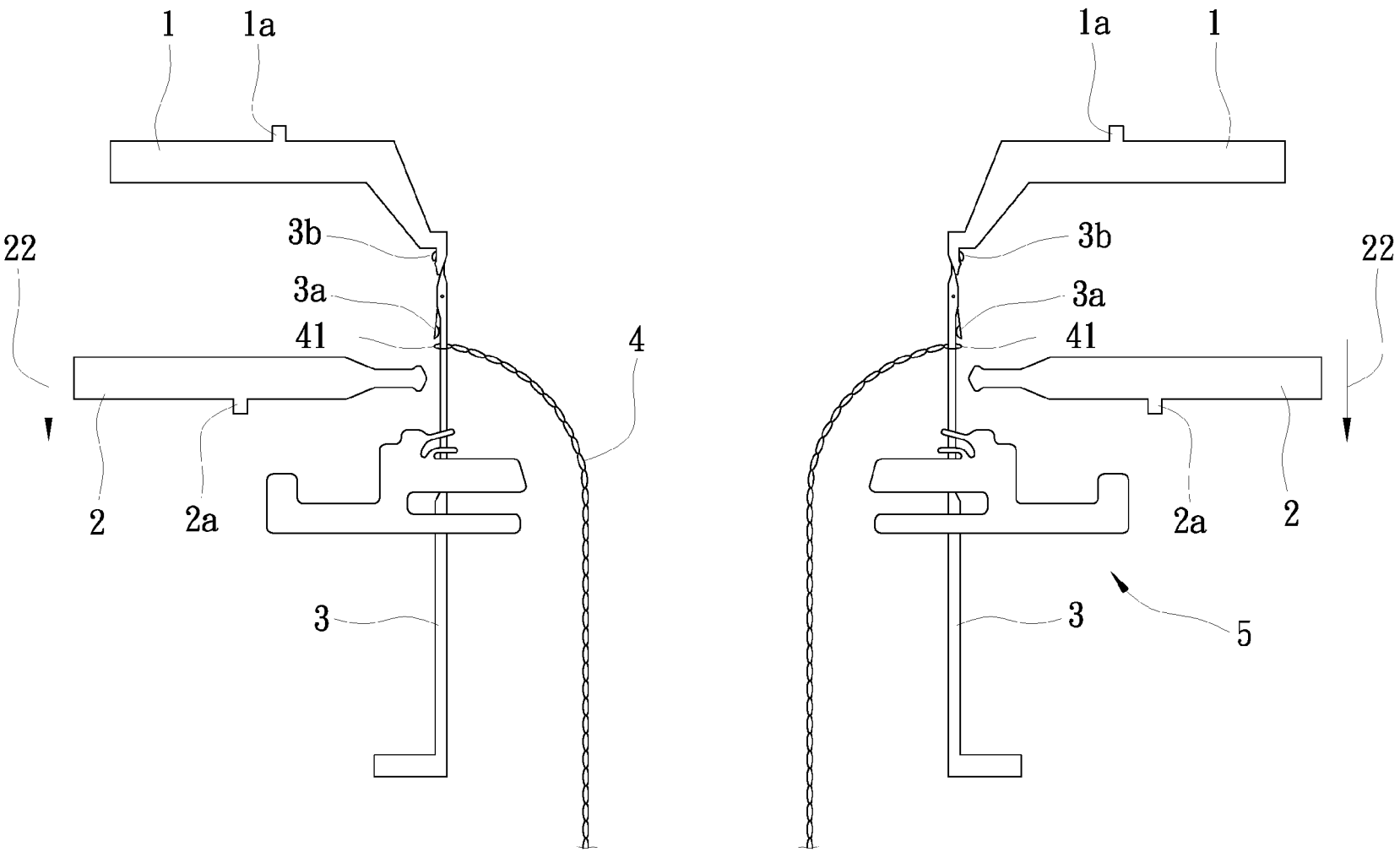
FIG. 7 illustrates a downward movement of the strip members.
Figure 8:
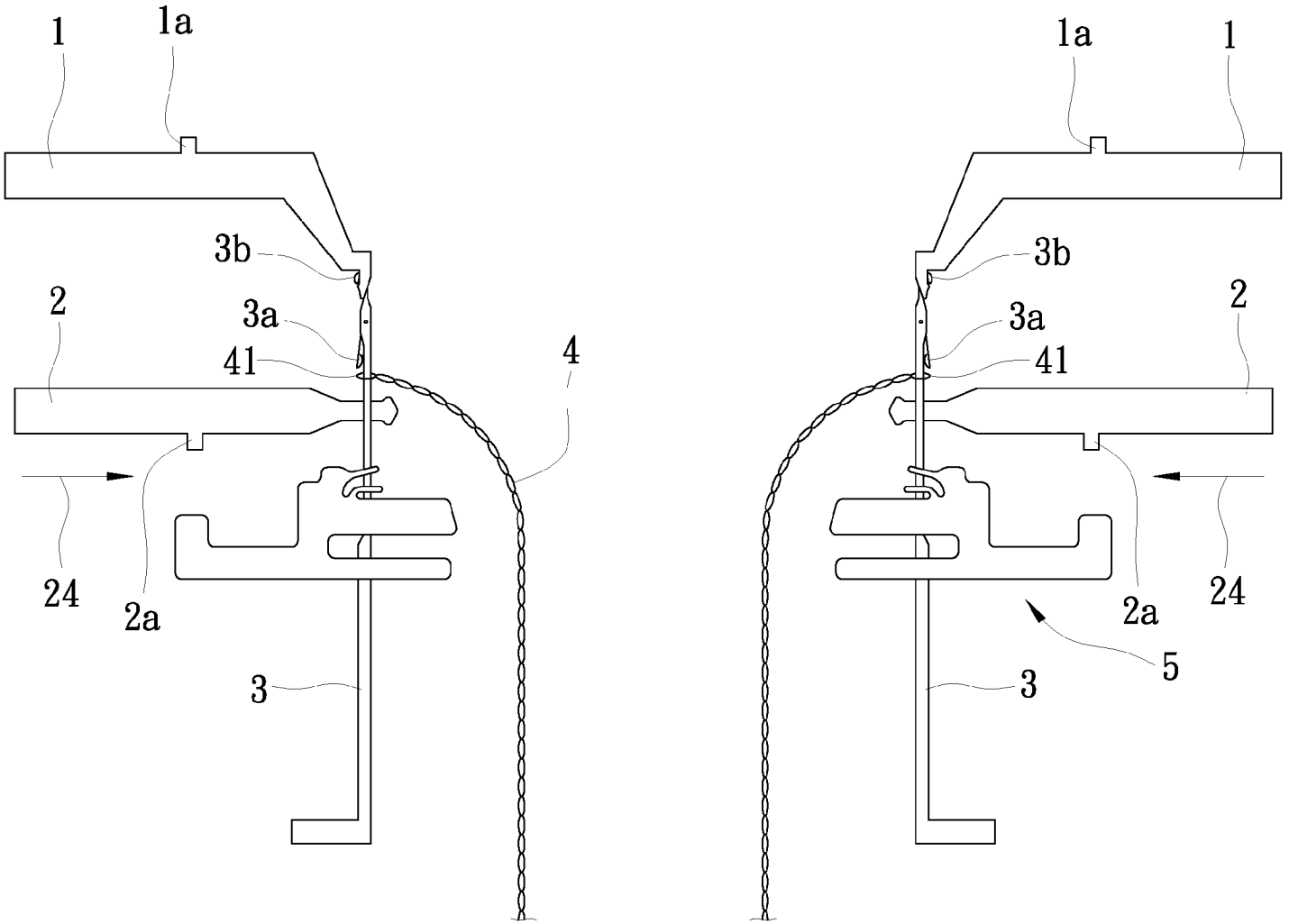
FIG. 8 shows the strip members moving back toward the respective needles below the loops.
Figure 9:
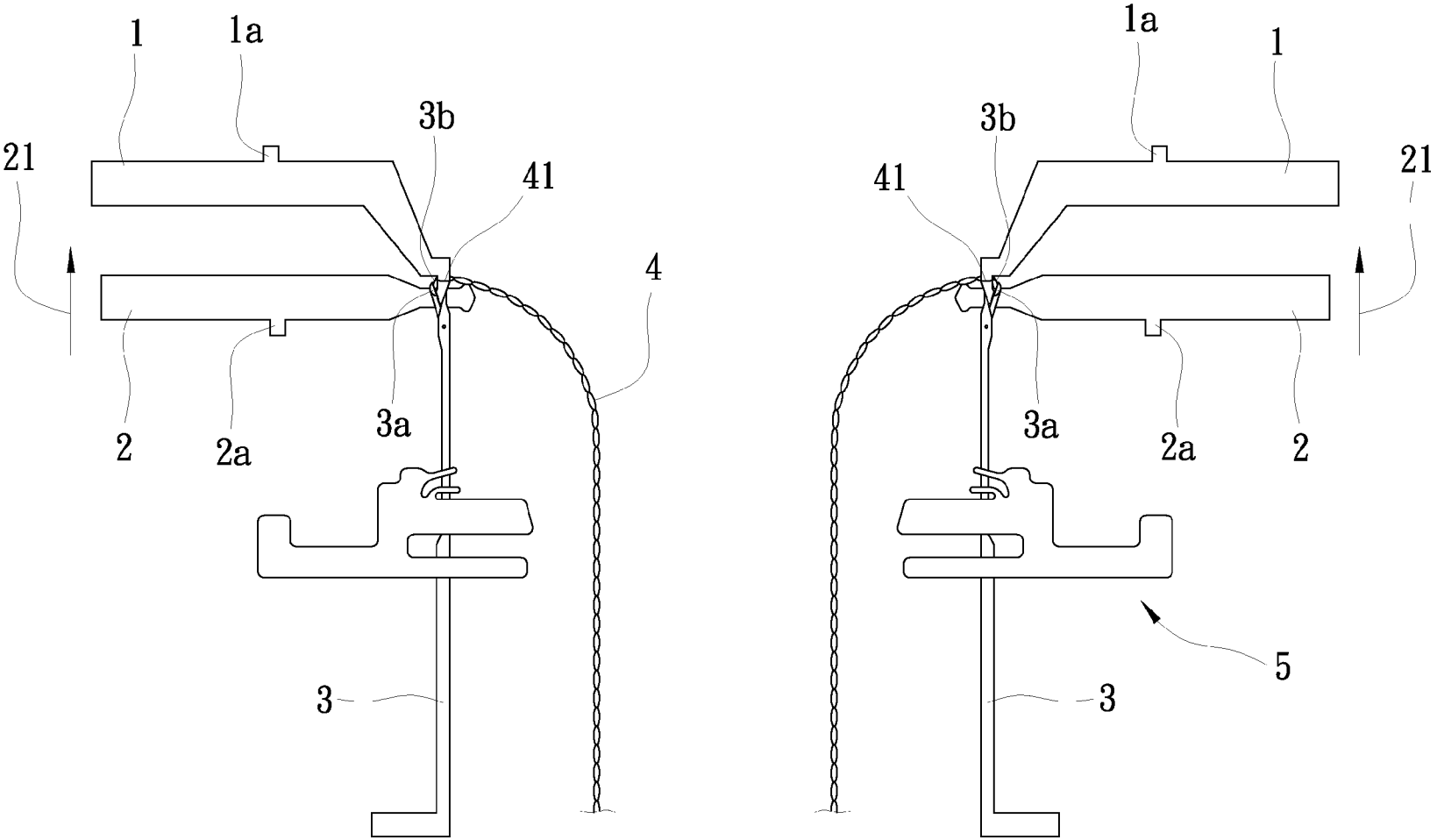
FIG. 9 shows the transfer of the loops of the stocking to the respective transfer members through an upward movement of the strip members.
Figure 32:
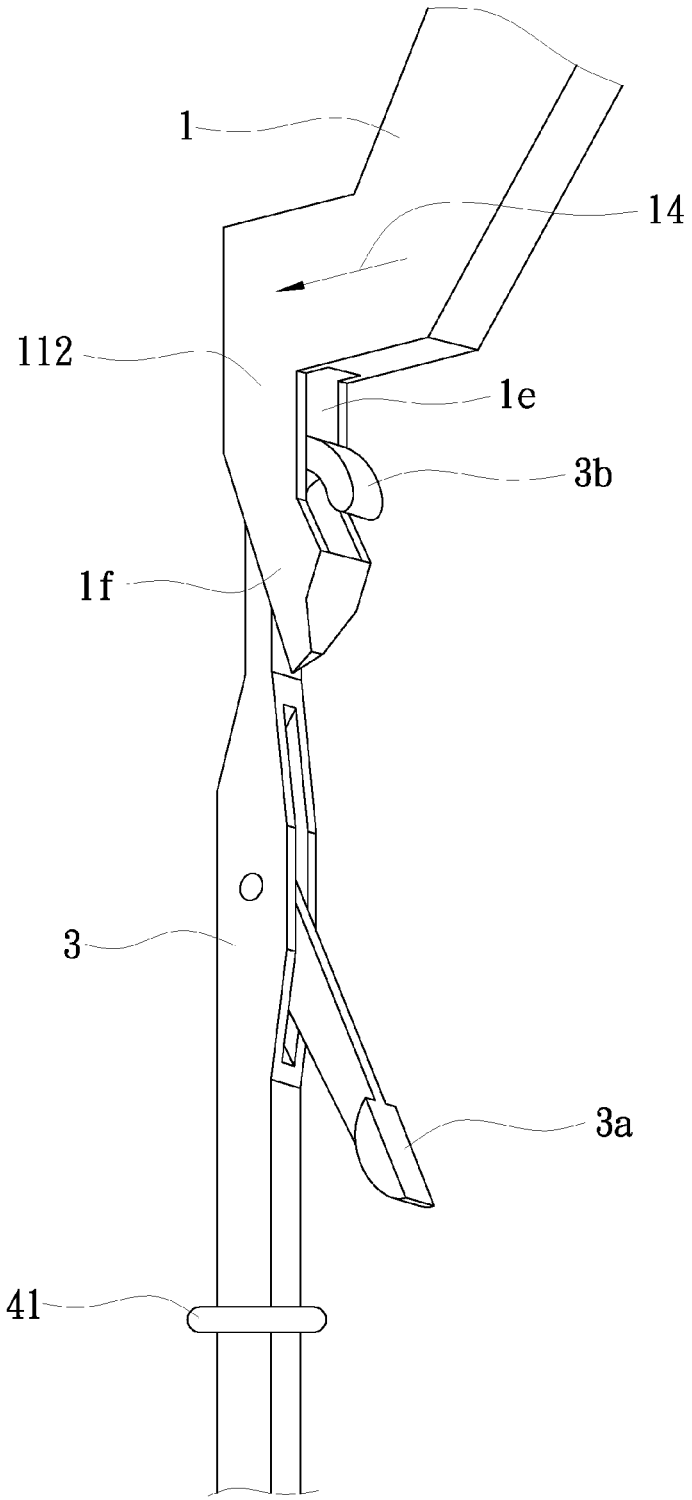
FIG. 32 shows the entry of the hook of the needle into a front opening in a tip region of the transfer member.
Figure 33:
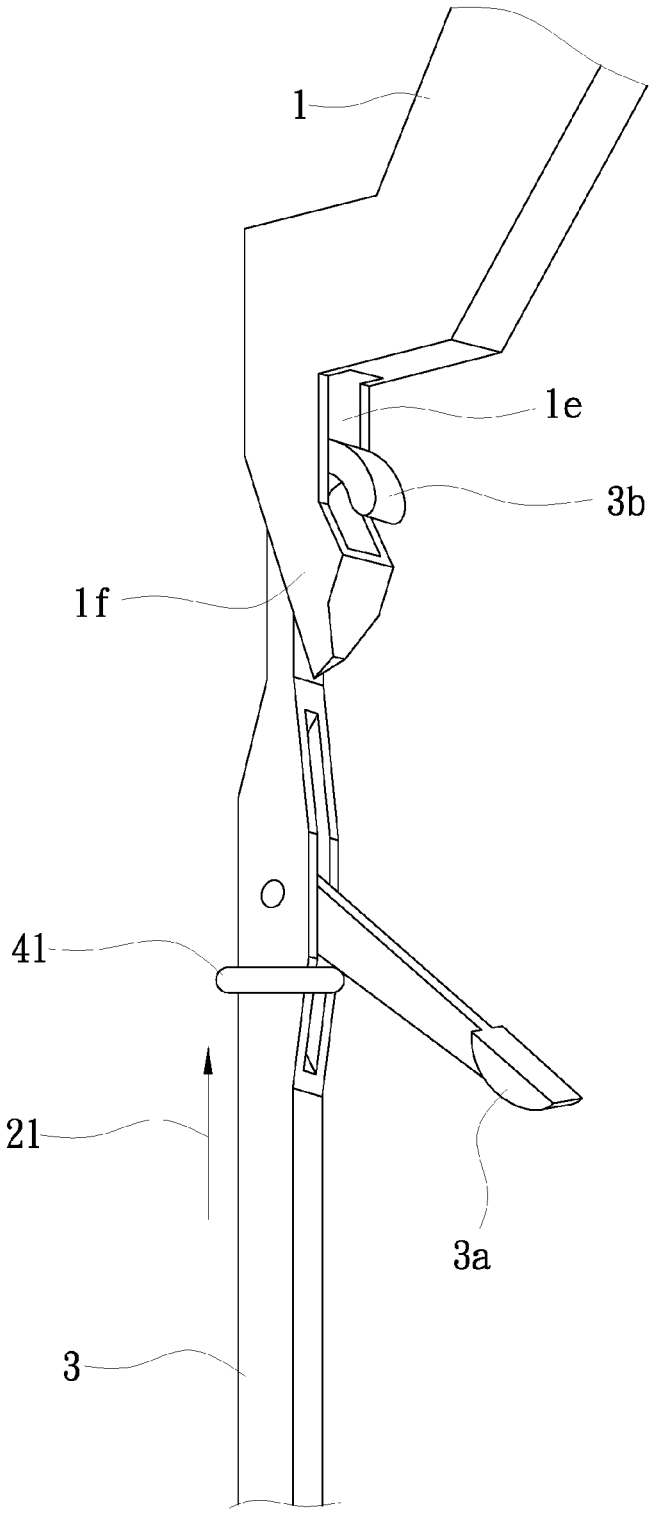
FIG. 33 shows the upward movement of the loop results in moving a latch of the needle to the hook.
Figure 34:
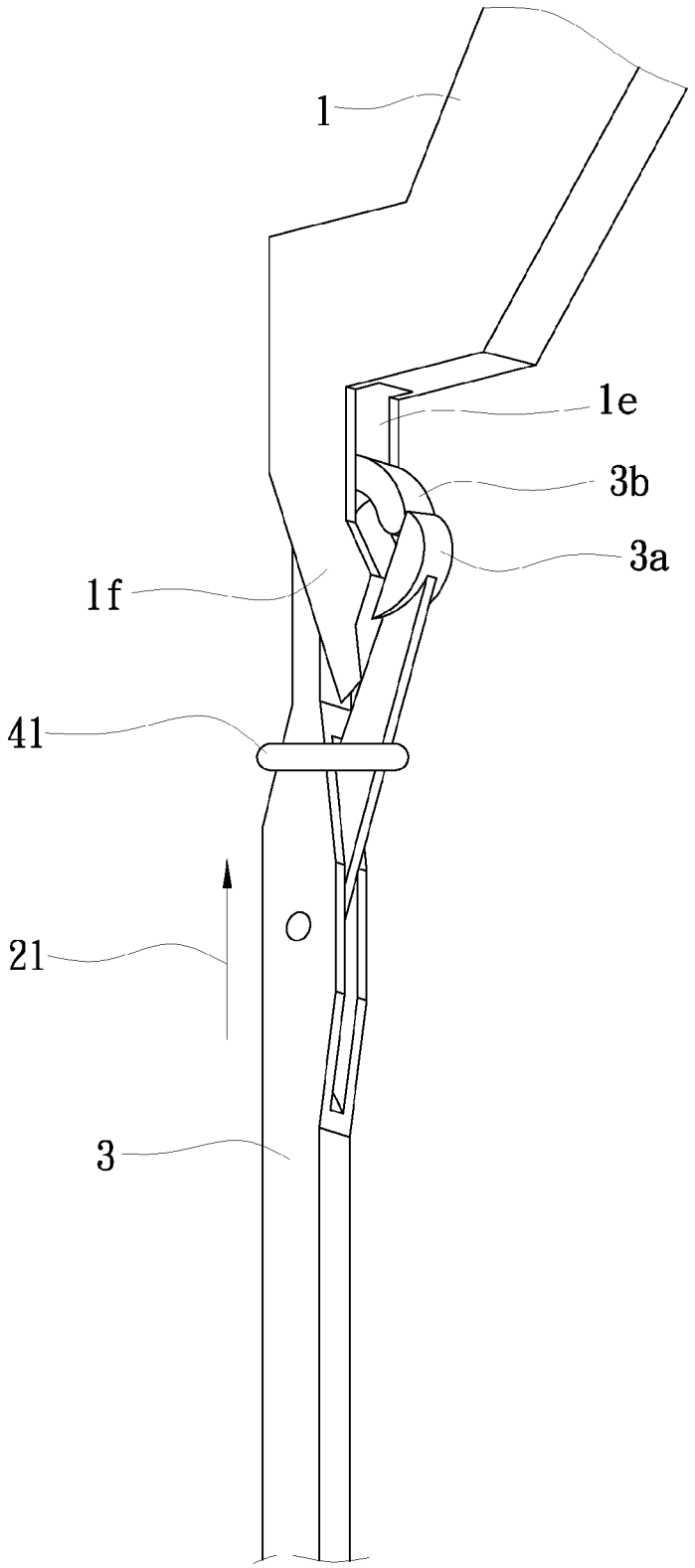
FIG. 34 shows the loop passing onto the latch.
Figure 35:
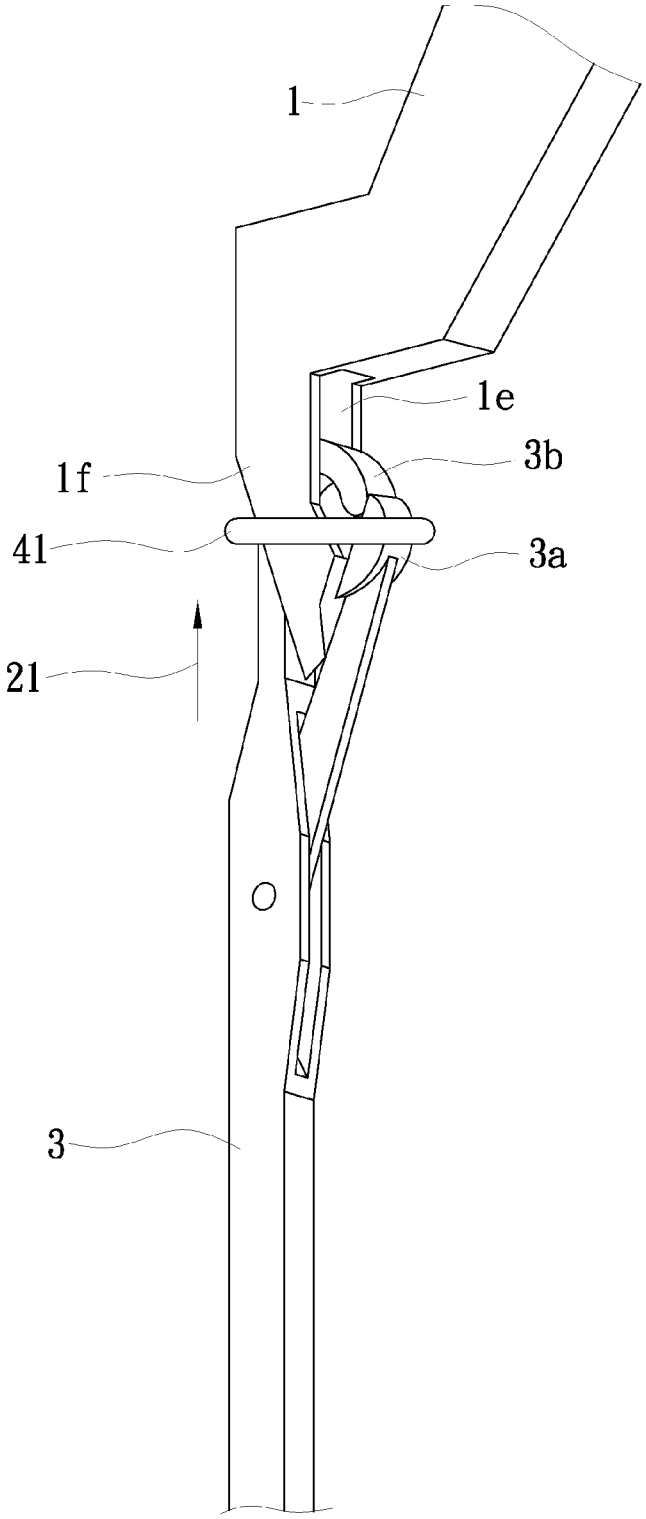
FIG. 35 shows the loop passing to a top part of the latch.
Figure 36:
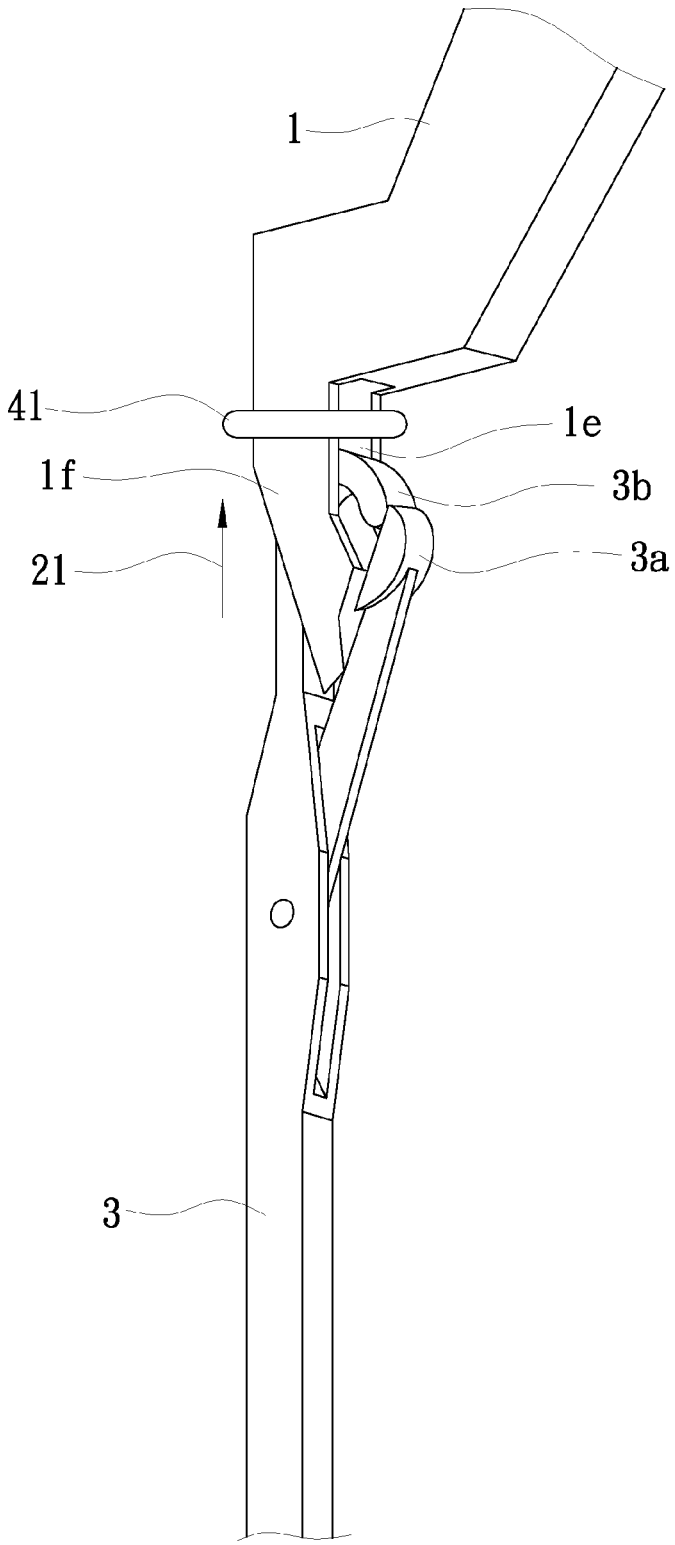
FIG. 36 shows the loop leaving the needle and being transferred to the transfer member.

As shown in FIG. 4, while each strip member (2) maintains its position, each transfer member (1) is moved toward the respective needle (3) in the direction of an arrow (14) until the transfer member (1) reaches the hook (3*b*) and until the hook (3*b*) extends into the front opening (1*e*) in the tip region (112) of the transfer member (1). This position is also shown in a perspective view in FIG. 32. The width of the front tip (1*f*) of each transfer member (1) has such a size and geometric form that enables the front tip (1*f*) to enter into and exit from the respective hook (3*b*). Once each transfer member (1) has assumed its position inside the respective hook (3*b*), each strip member (2) is moved downward over some distance until the loop (41) passes and is released from the respective latch (3*a*). This condition is shown in FIGS. 5 and 32. As shown in FIG. 6, after each strip member (2) has released the loop (41) from the respective latch (3*a*), it is then moved backward in the direction of an arrow (23) to come out of between the needles (3), and as shown in FIG. 7, each strip member (2) is moved downward over some further distance in the direction of the arrow (22) below the respective loop (41). As shown in FIG. 8, each strip member (2) is then moved close again in the direction of an arrow (24), and enters between the two needles (3) in such a way that it can contact and push the respective loop (41) from below. Then, as shown in FIGS. 9 and 36, each strip member (2) is moved upward in the direction of an arrow (21) to slide the loop (41) upward and toward the hook (3*b*) to enable each loop (41) to be transferred from the respective hook (3*b*) to the respective transfer member (1).

Figure 10:
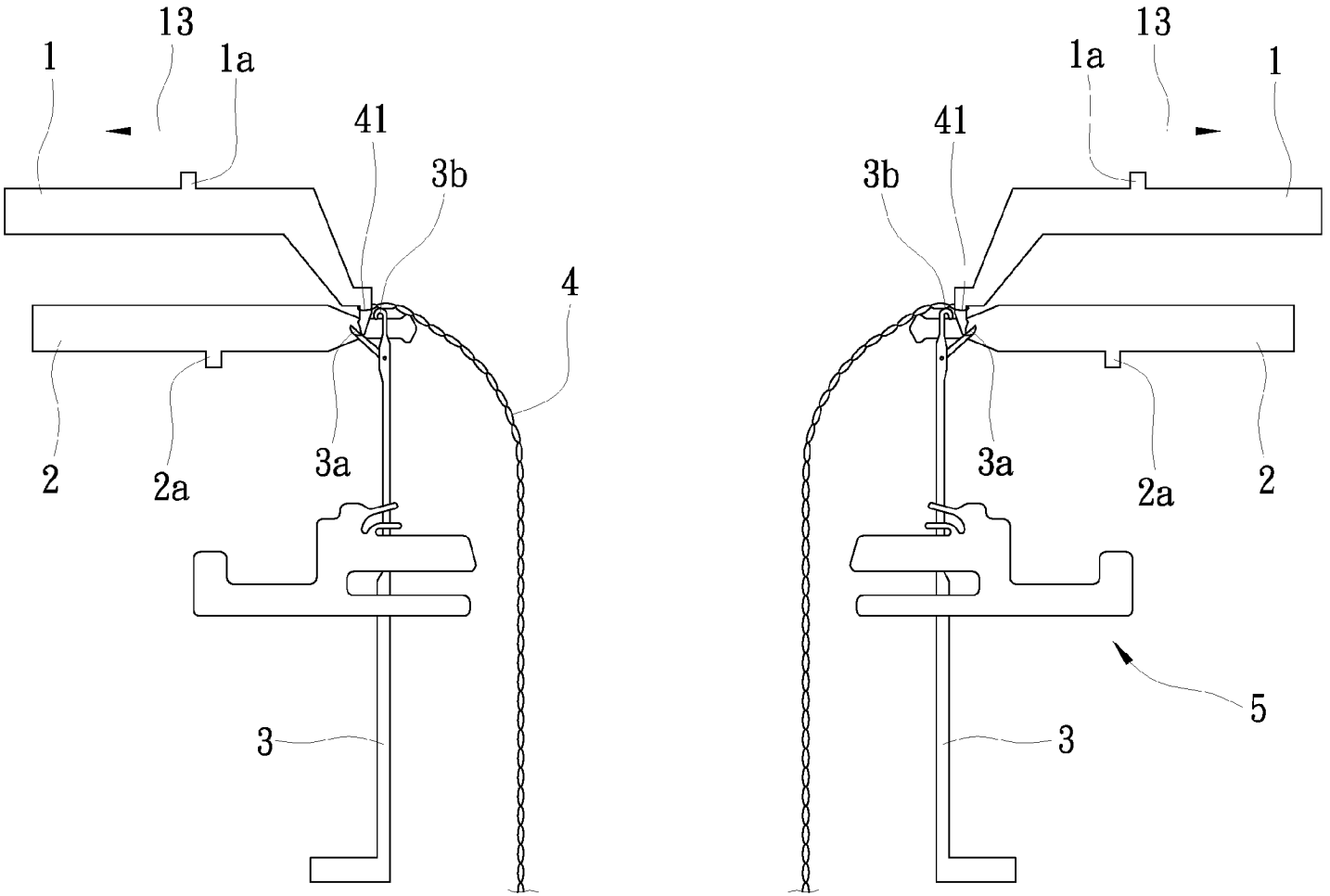
FIG. 10 shows the transfer members being moved away from the hooks of the respective needles.
Figure 11:
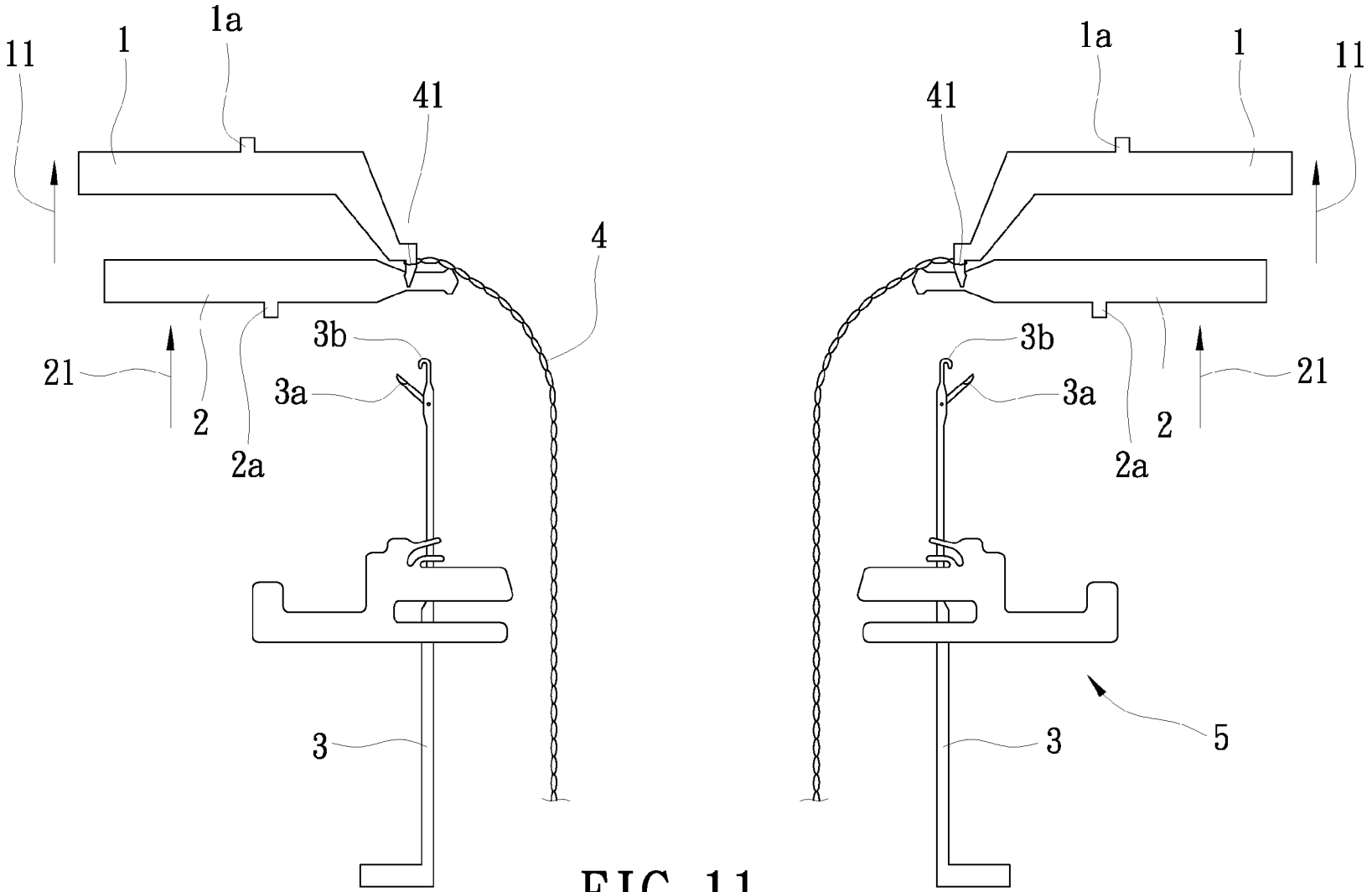
FIG. 11 illustrates the separation of the stocking from the stocking machine through an upward movement of the transfer and strip members of the transfer apparatus.
Figure 37:
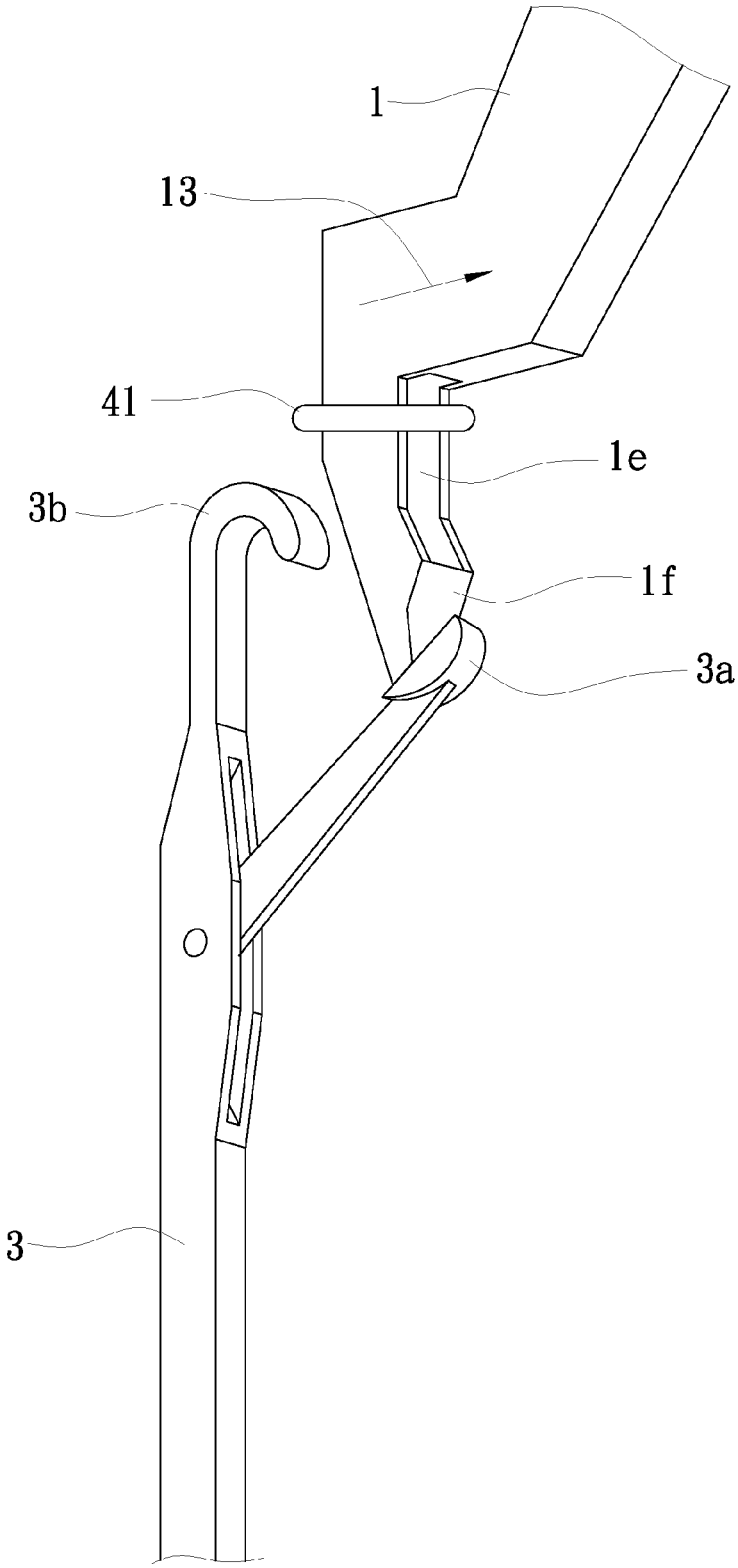
FIG. 37 shows the transfer member being moved away from the needle.
Figure 38:
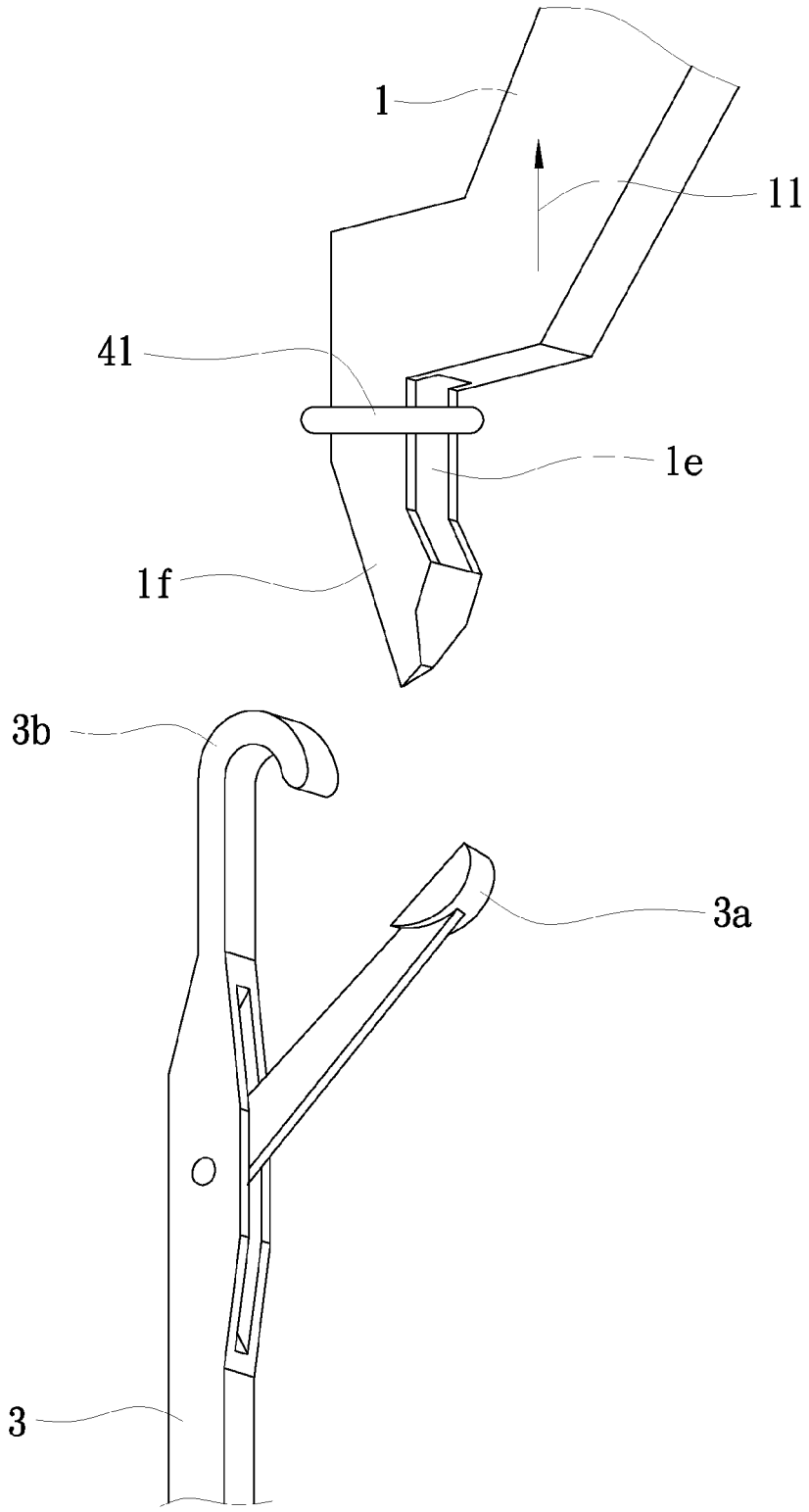
FIG. 38 shows the movement of the transfer member away from the needle.

As shown in FIGS. 10 and 37, each transfer member (1) is moved backward in the direction of an arrow (13) to be released from the respective hook (3*b*). The transfer members (1) and the strip members (2) are simultaneously moved upward in the direction of the arrows (11) and (21), respectively, and away from the needles (3) while each strip member (2) is still in contact with the respective loop (41) from below to stabilize each loop (41) on the respective transfer member (1). Hence, the loops (41) of the stocking (4) are now completely taken by the transfer members (1) and the strip members (2) (see FIG. 11).

Figure 12:
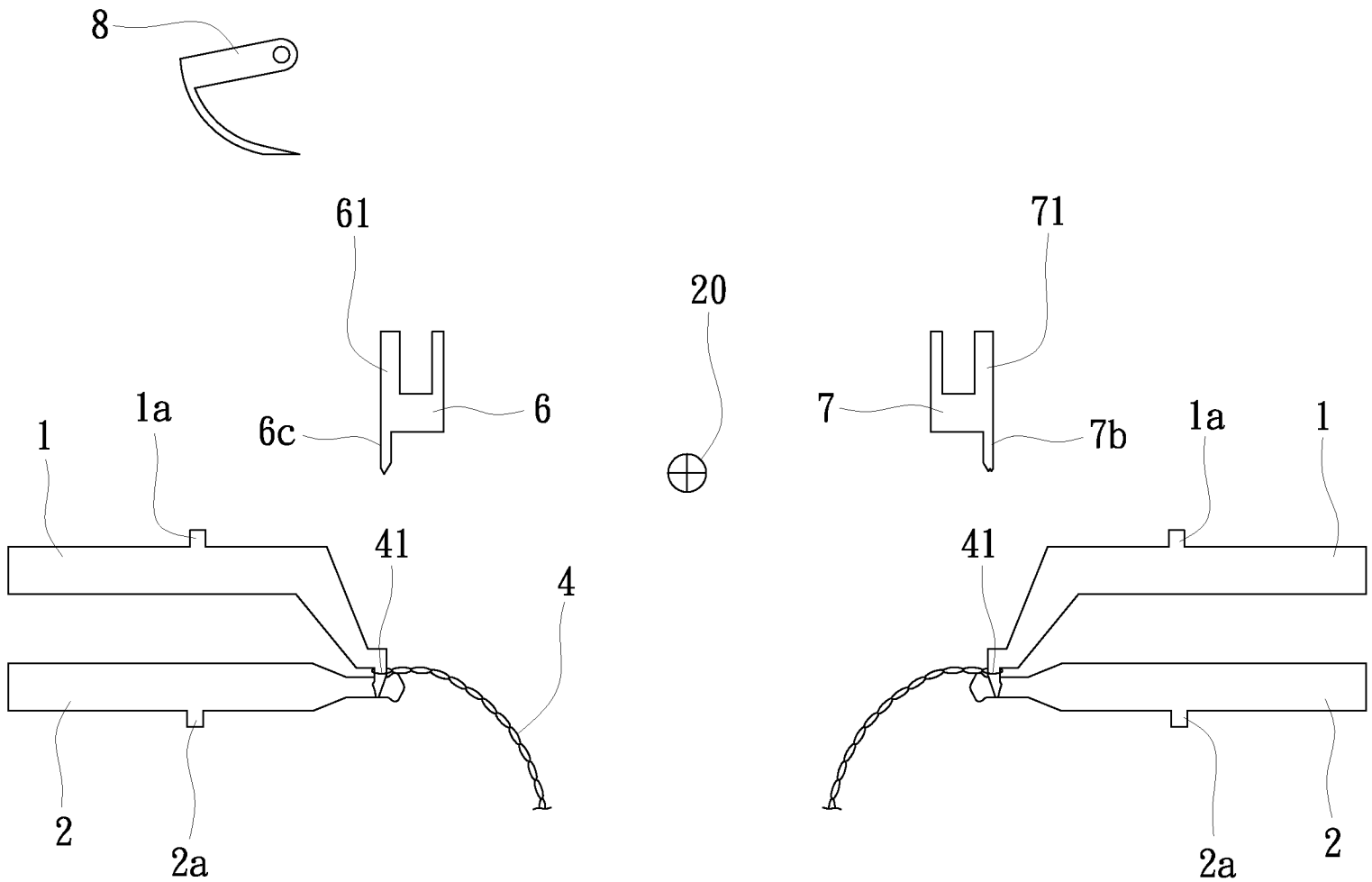
FIG. 12 shows the stocking being moved to a stitching apparatus by the transfer and strip members of the transfer apparatus.
Figure 13:
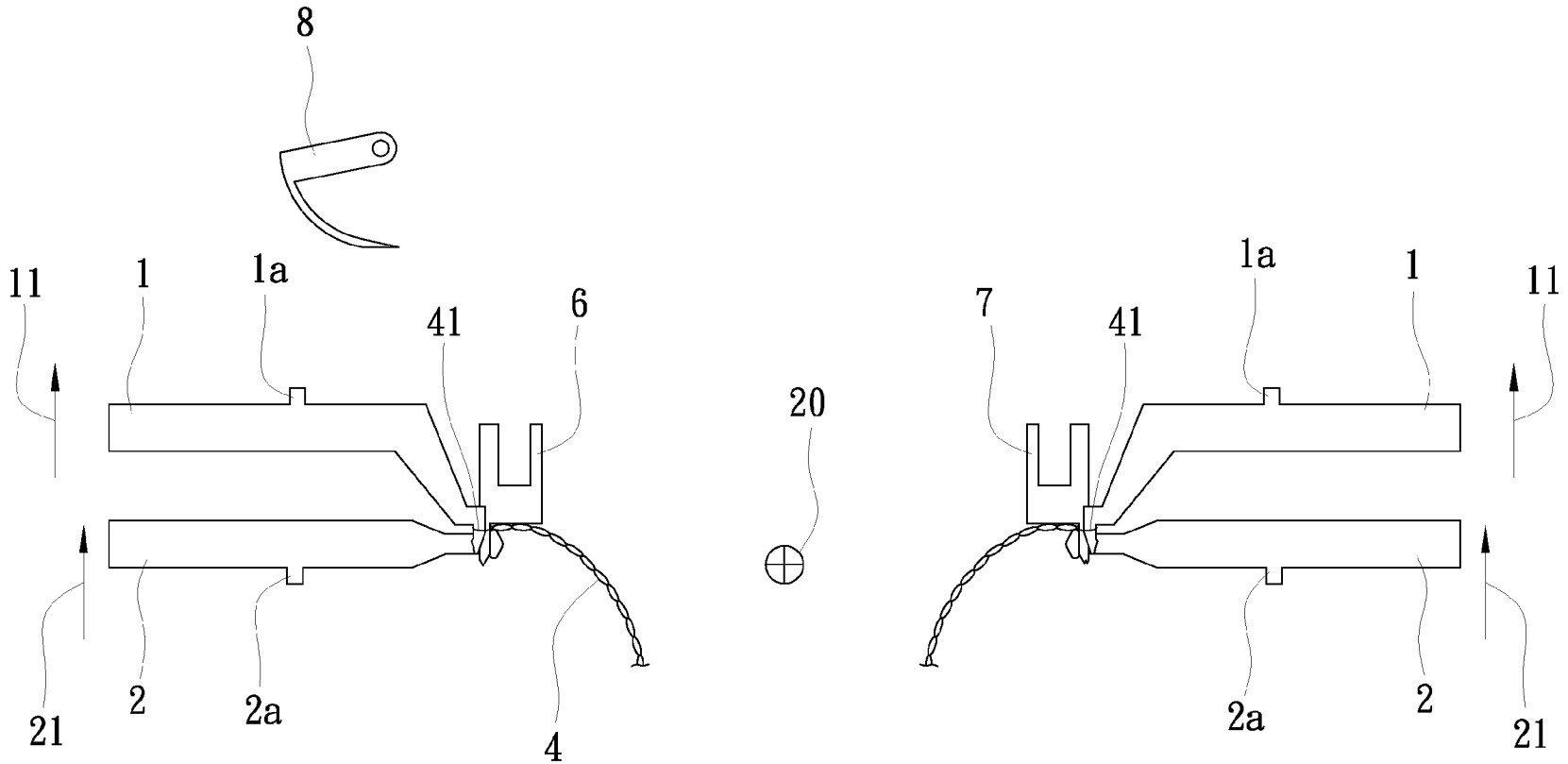
FIG. 13 illustrates the attachment of the loops of the stocking to teeth of a reed of the stitching apparatus through an upward movement of the transfer and strip members.
Figure 28:
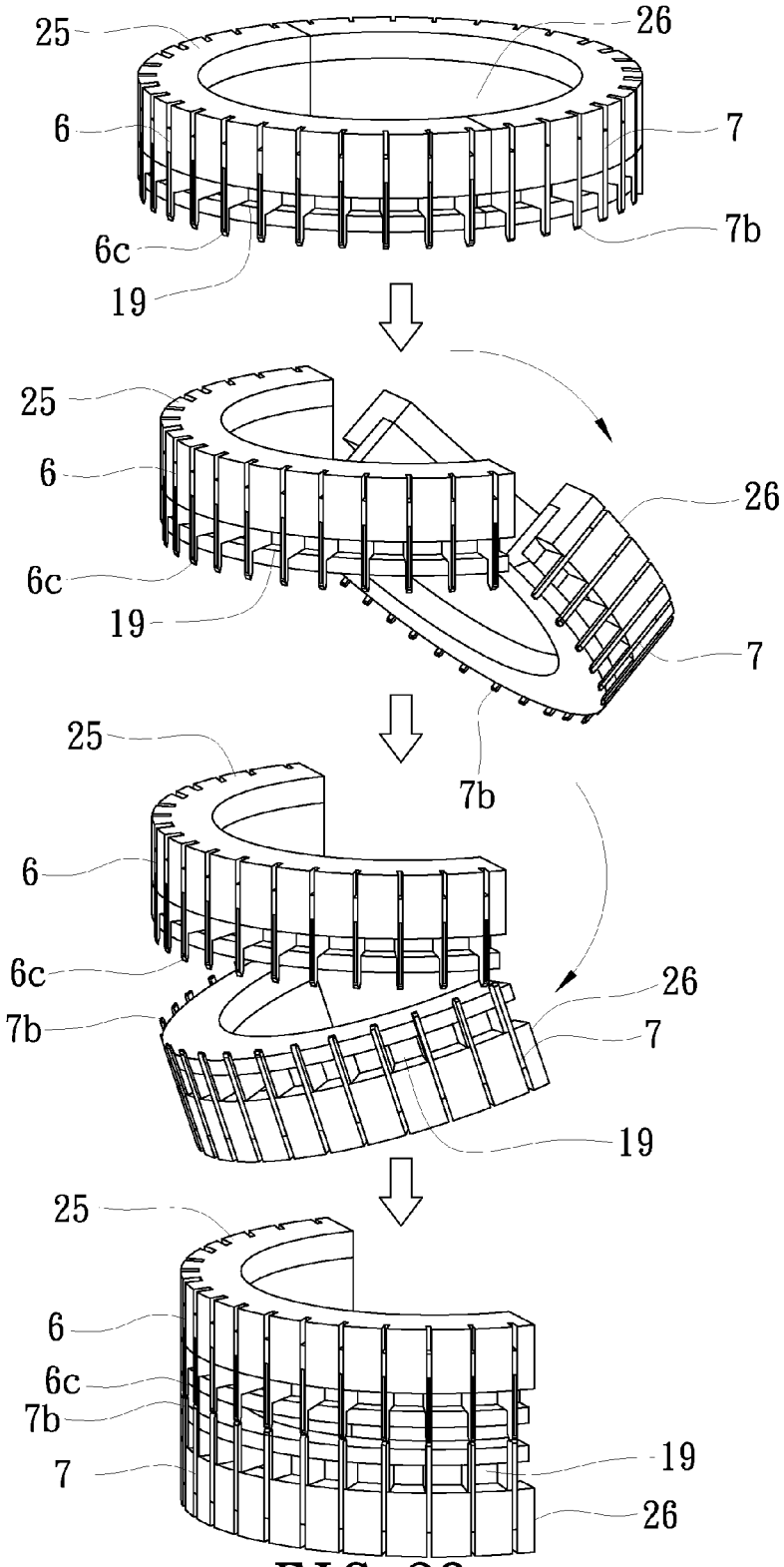
FIG. 28 is a perspective view of the reed of the stitching apparatus, illustrating how the female reed section collapses below the male reed section.
Figure 29:
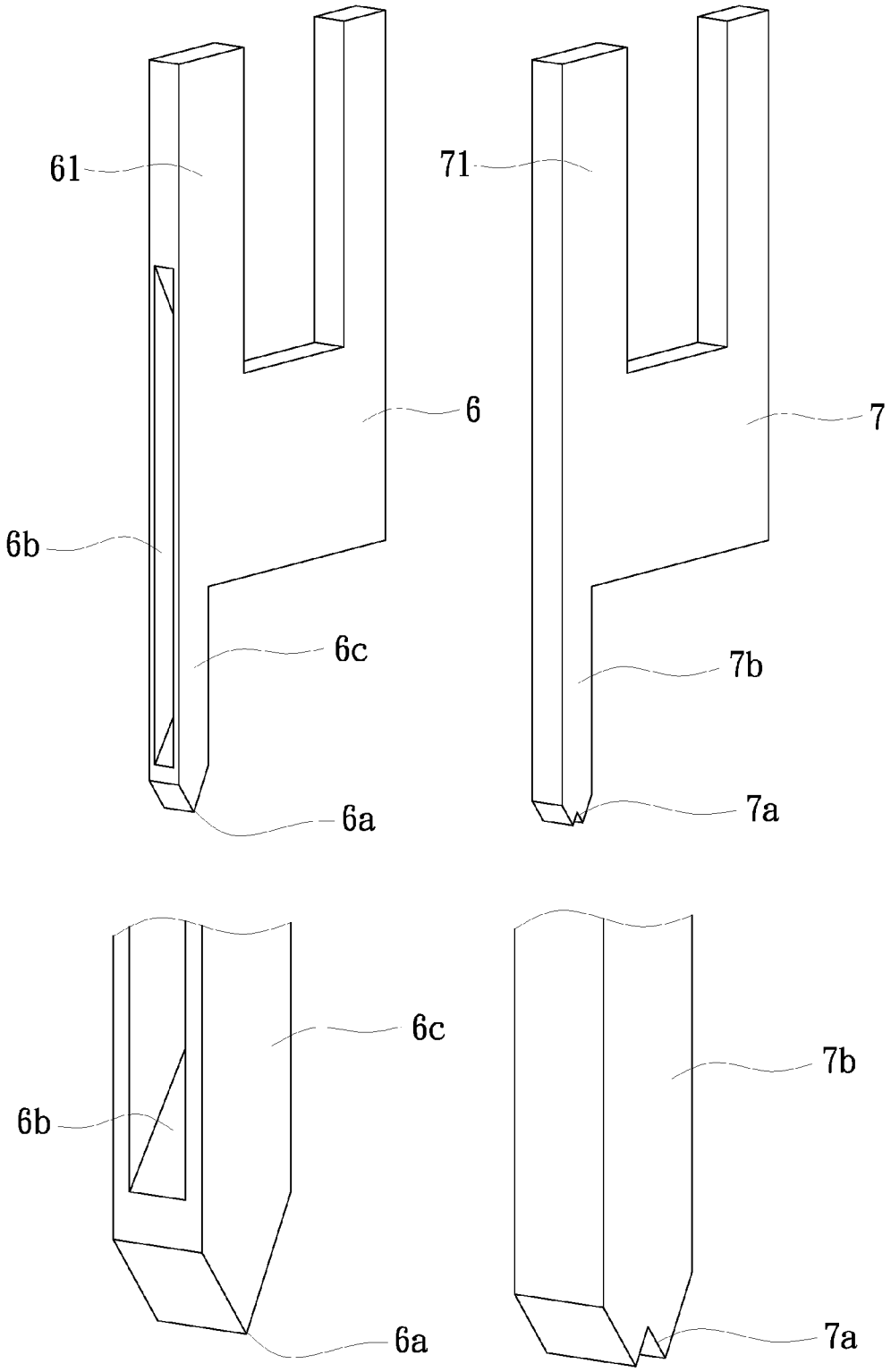
FIG. 29 shows a perspective view of the structures of the male and female reed sections.

As shown in FIG. 12, in combination with FIGS. 28 and 29, the loops (41) of the stocking (4) taken from the stocking machine (5) are carried to a circular toe stitching apparatus through the transfer and strip members (1, 2). That is, the strip and transfer members (2, 1) together with the respective loops (41) are moved until the transfer members (1) reach a reed of the stitching apparatus. The reed of the stitching apparatus includes a semi-circular male reed section (25) having male reed teeth (6) arranged in a way to have gaps (19) in-between and in an amount to cover the circumference of a semi-circle, and a semi-circular female reed section (26) having female reed teeth (7) arranged in a way to have gaps (19) in-between, in an amount to cover the circumference of a semi-circle, and collapsible relative to the male reed section (25). The reed teeth (6, 7) have as many as the number of the transfer members (1) arranged in a circular manner. Each female reed tooth (7) is collapsible in the direction of an arrow (9) (see FIG. 17) and openable in the direction of an arrow (10) (see FIG. 22) relative to the male reed tooth (6). Each reed tooth (6, 7) comprises an extension (6*c*, 7*b*) extending downward from a shank (61, 71) thereof. As shown in FIG. 13, through the upward movement of the transfer and strip members (1, 2) in the direction of the arrows (11) and (21), respectively, the extension (6*c*, 7*b*) of each reed tooth (6, 7) enters the top opening (1*g*) (see FIG. 41) in the corresponding transfer member (1). This position is shown according to a perspective view in FIG. 41.

Figure 14:
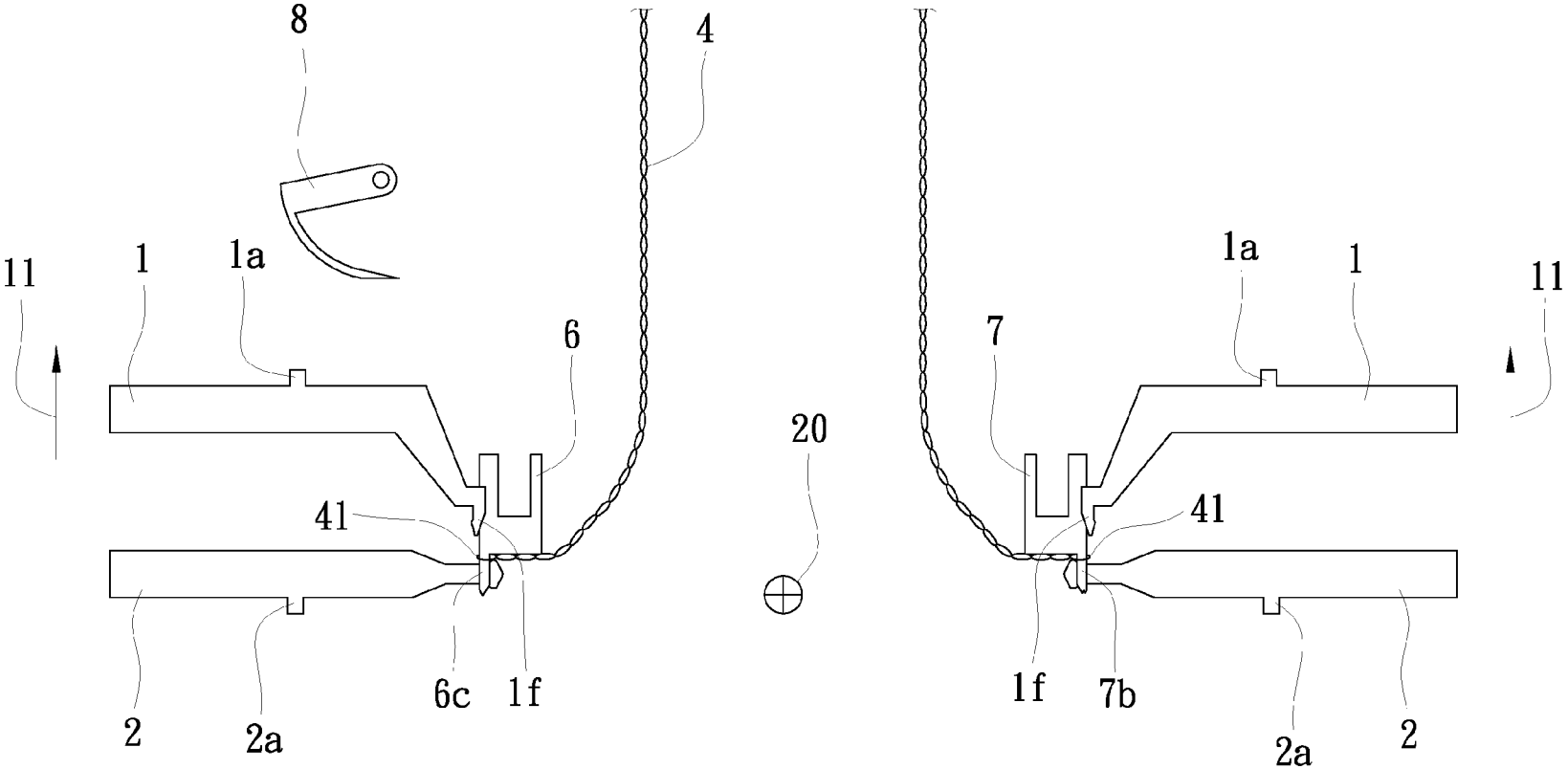
FIG. 14 depicts the reversal of the stocking and the complete transfer of the loops onto the teeth of the reed through an upward movement of the transfer member.
Figure 15:
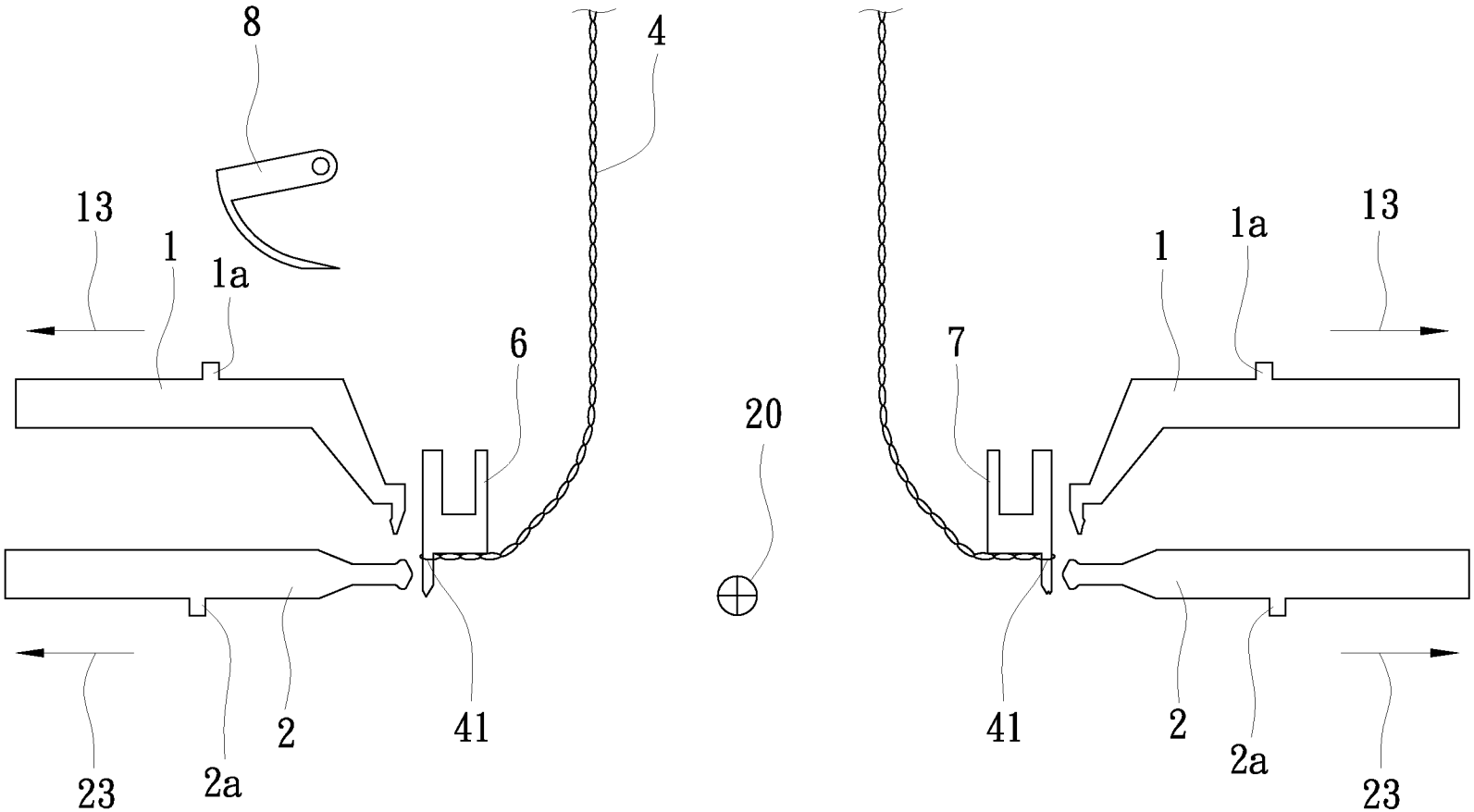
FIG. 15 depicts the movement of the transfer and strip members away from the teeth of the reed.
Figure 42:
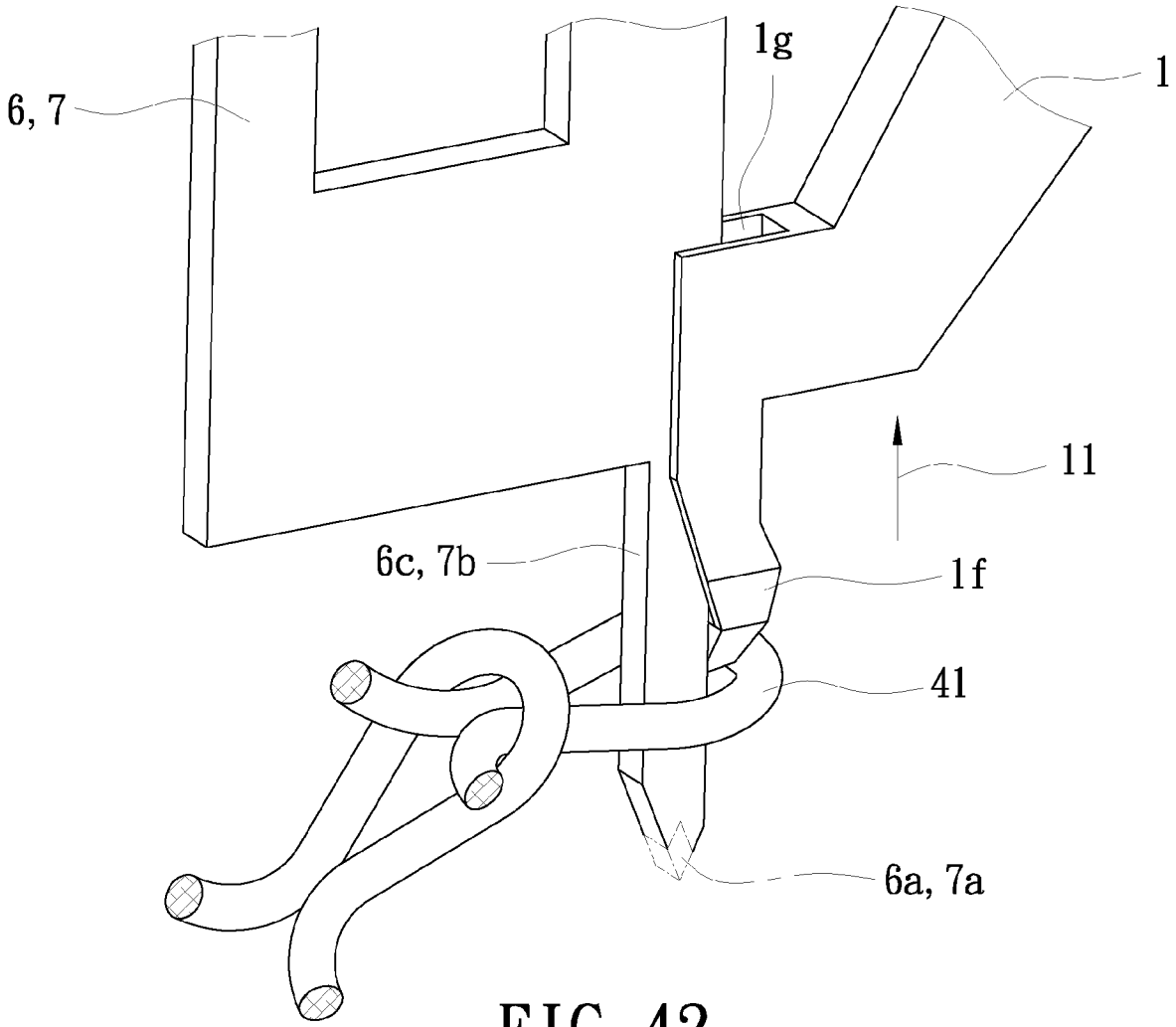
FIG. 42 shows the upward movement of the transfer member to transfer the loop to the tooth of the reed.

As shown in FIGS. 14 and 42, each transfer member (1) is moved upward in the direction of the arrow (11) to some extent to release the front tip (1*f*) from the respective loop (41) of the stocking (4). In this way, each loop (41) can be transferred to the corresponding reed tooth (6, 7). Then, as shown in FIG. 15, each transfer member (1) is moved backward in the direction of the arrow (13) to move away from the corresponding reed tooth (6, 7). Similarly, each strip member (2) is moved away from the corresponding reed tooth (6, 7) in the direction of the arrow (23). As a result, the loops (41) in a quantity corresponding to the number of the transfer members (1) are transferred to the corresponding reed teeth (6, 7) of the toe stitching apparatus.

Figure 16:
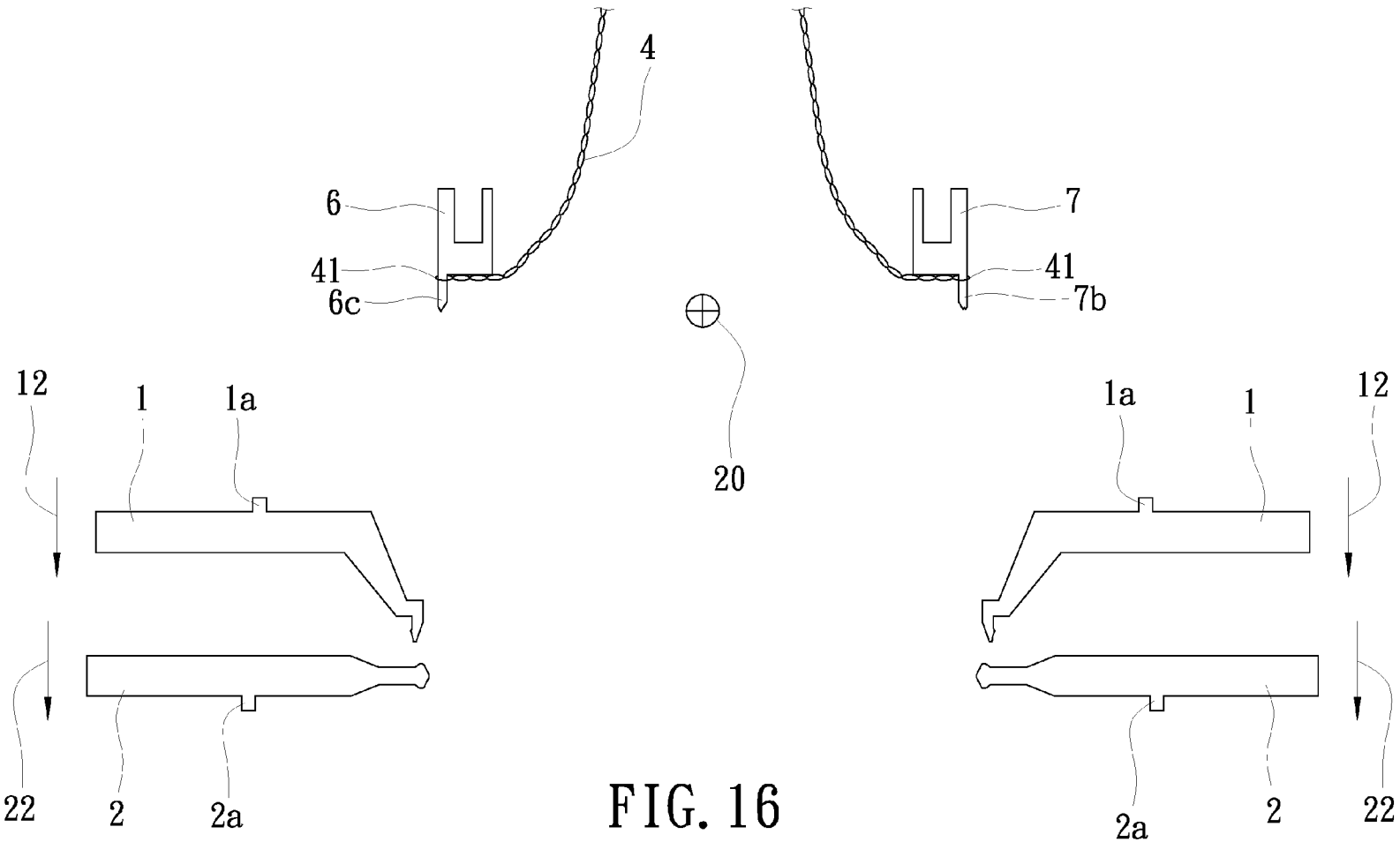
FIG. 16 shows the downward movement of the transfer and strip members.
Figure 17:
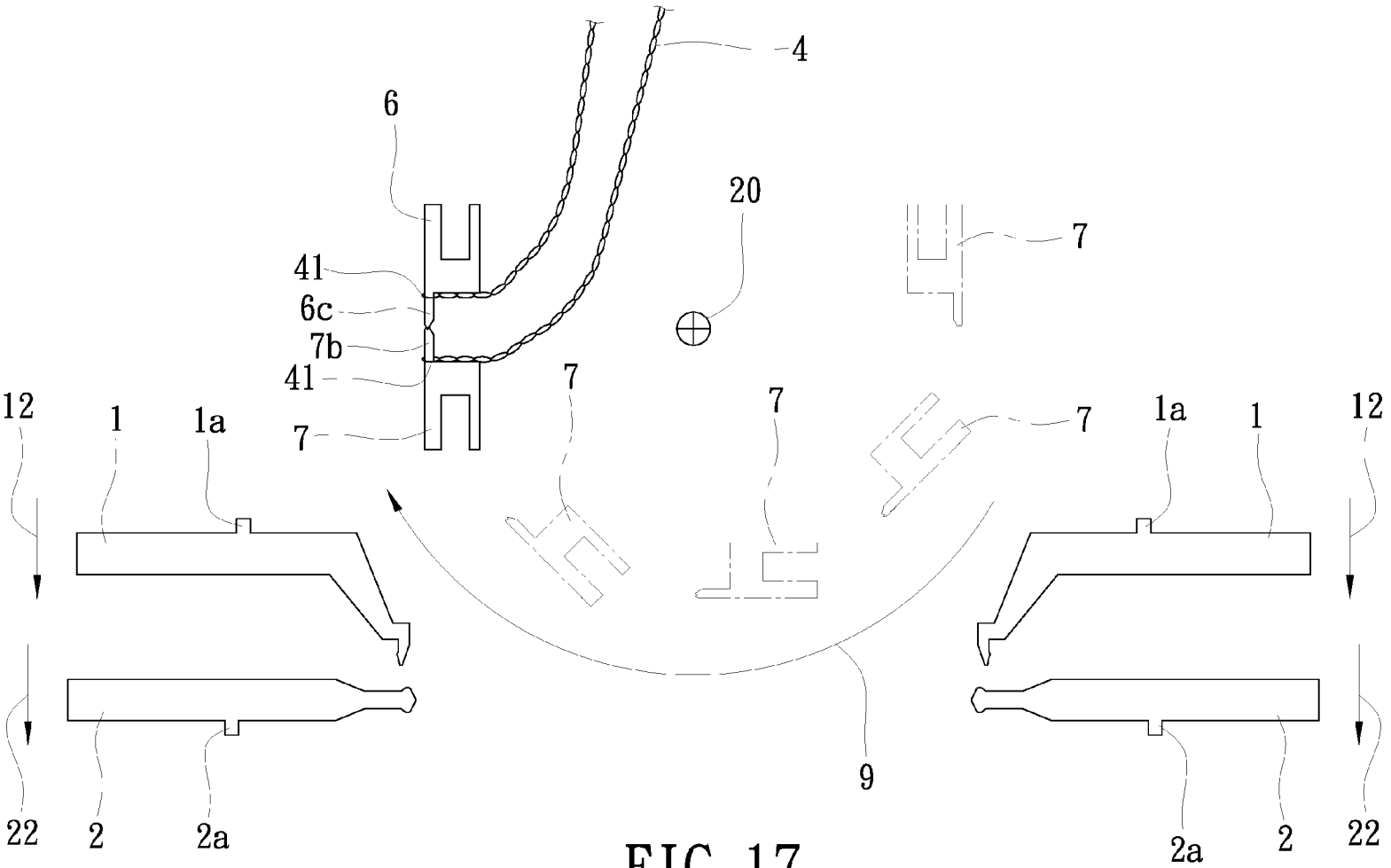
FIG. 17 depicts the collapsing of a female reed section of the reed onto a male reed section thereof.
Figure 30:
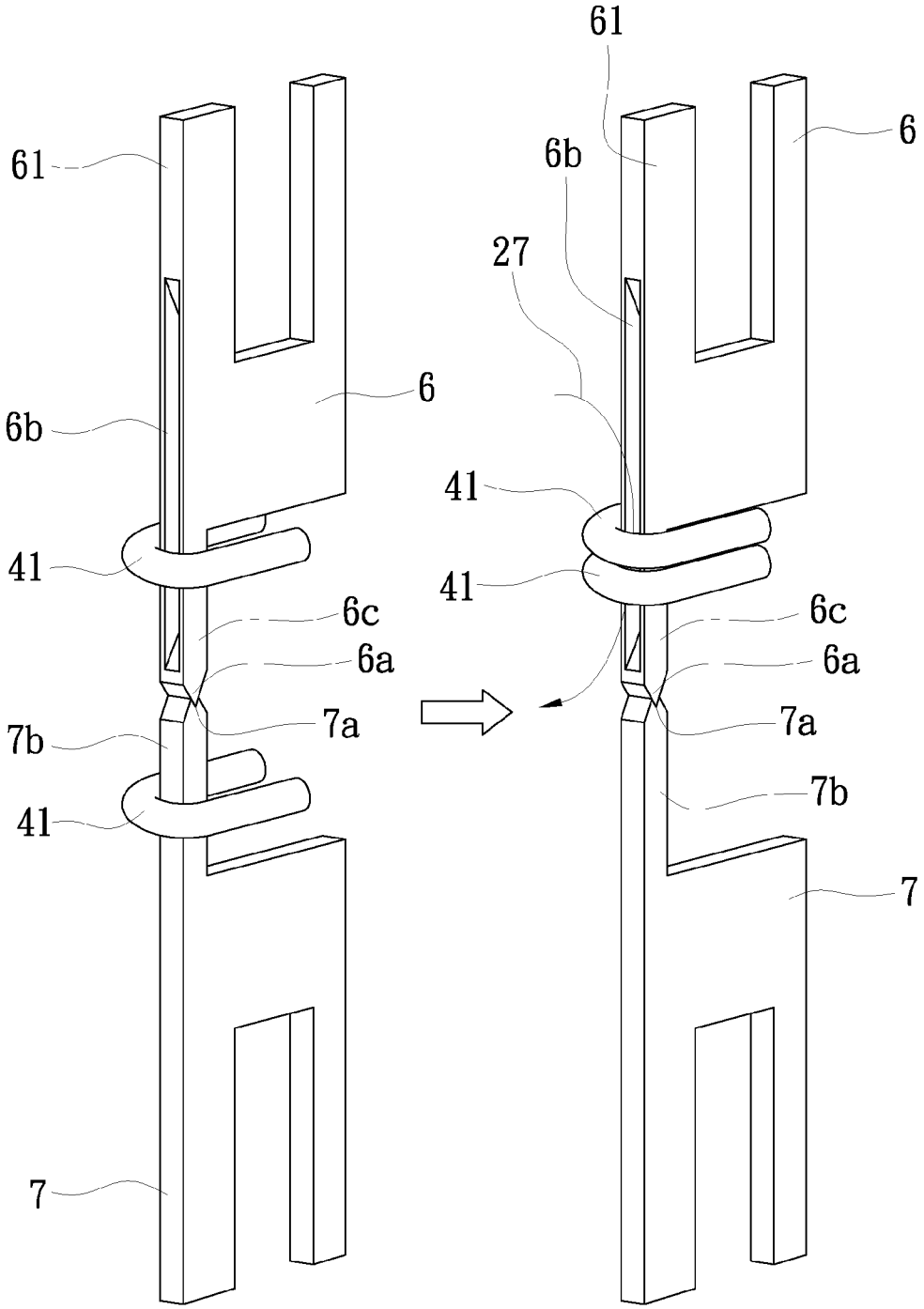
FIG. 30 shows a perspective view of the transfer of the loop from the female reed tooth to the male reed tooth.

As shown in FIG. 16, through the downward movement of the transfer and strip members (1, 2) in the direction of the arrows (12) and (22), respectively, and away from the reed, a clearance required for collapsing of the female reed tooth (7) relative to the male reed tooth (6) is provided. As shown in FIGS. 17, 28, and 30, the female reed section (26) collapses relative to the male reed section (25) to align vertically and contact the female reed teeth (7) with the male reed teeth (6), respectively. Since there is an even number of needles (3) in all the stocking machines (5) and since the transfer members (1), the strip members (2), and the sum of the teeth (6, 7) on the reed sections (25, 26) are accordingly present in a quantity corresponding to the number of the needles (3), these are also present in even numbers. For this reason, when the reed is collapsed, there is present a male reed tooth (6) corresponding to a female reed tooth (7).

Figure 18:
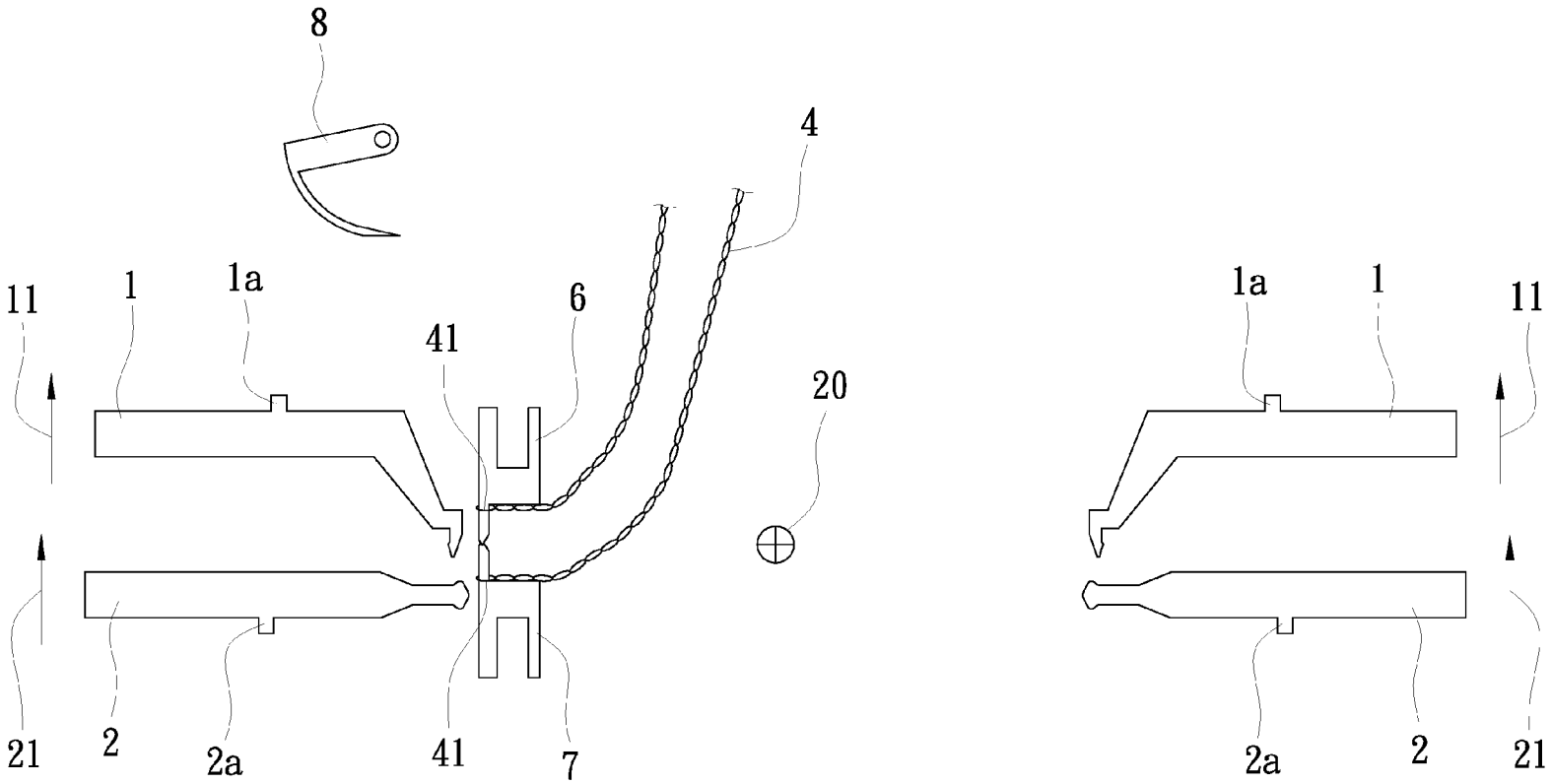
FIG. 18 shows the upward movement of the transfer and strip members.
Figure 19:
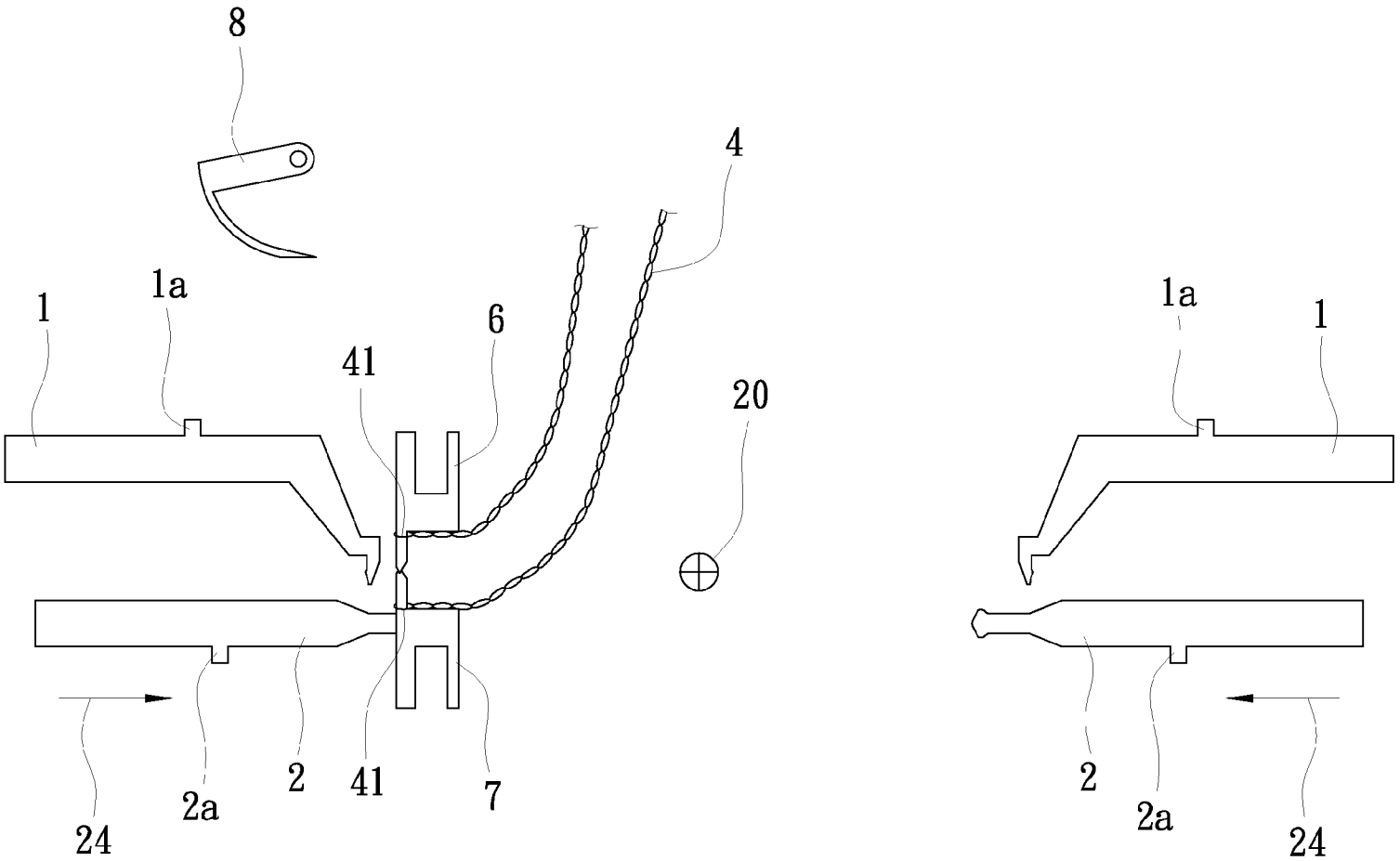
FIG. 19 shows the movement of one of the strip members to the female reed section.

As shown in FIG. 18, the transfer and strip members (1, 2) are moved upward in the direction of the arrows (11) and (12), respectively, until the left strip member (2) is aligned with the gap (19) (see FIG. 28) between two female reed teeth (7). Then, as shown in FIG. 19, the left strip member (2) enters the gap (19) by moving forward in the direction of the arrow (24).

Figure 20:
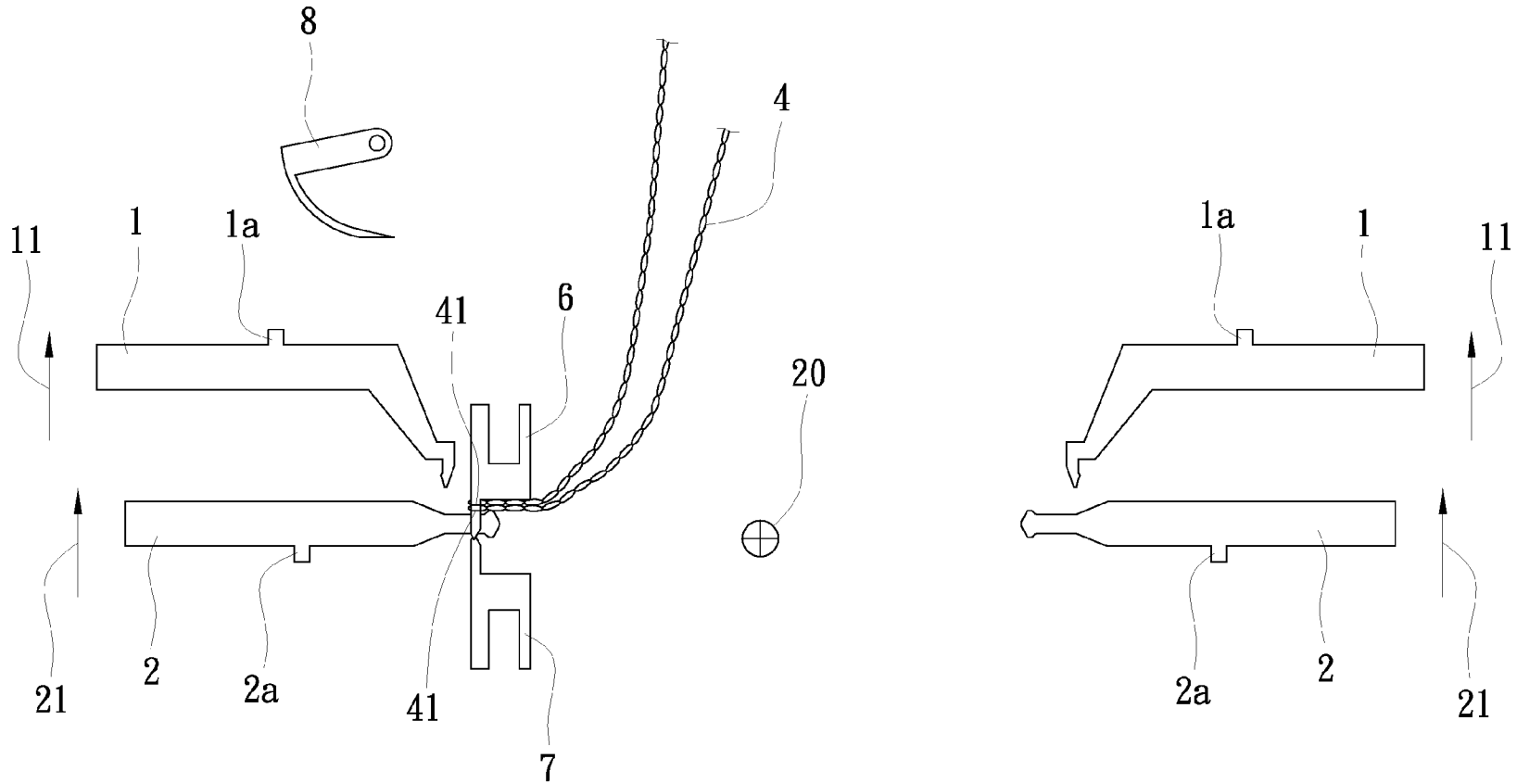
FIG. 20 shows the transfer of the loop from the tooth of the female reed section to the tooth of the male reed section through an upward movement of the transfer and strip members.

As shown in FIGS. 20 and 30, through the upward movement of the transfer members (1) and the strip members (2), the loop (41) on the female reed tooth (7) is pushed and stripped upward by the left strip member (2) to combine with the loop (41) on the respective male reed tooth (6). In other words, all the loops (41) in the female reed teeth (7) are transferred to the male reed teeth (6) so that the loops (41) on the aligned male and female reed teeth (6, 7) are juxtaposed for stitching, and so that two loops (41) are present on each male reed tooth (6).

According to the present invention, in order to achieve a reliable loop transfer from one tooth to another, the tip of the transferring tooth is designed to have a preferably female form, while the receiving tooth is designed to have a preferably male form. With reference to FIGS. 29 and 30, the tip (7*a*) of each female reed tooth (7) is formed with a groove, while the tip (6*a*) of each male reed tooth (6) is substantially wedge-shaped to mate with the groove. Each male reed tooth (6) further has a reed tooth extension (6*c*) extending downward from the shank (61) thereof and having the tip (6*a*), and a channel (6*b*) (see FIG. 29) formed in an outer surface of the reed tooth extension (6*c*) and extending partially into the shank (61).

Figure 21:
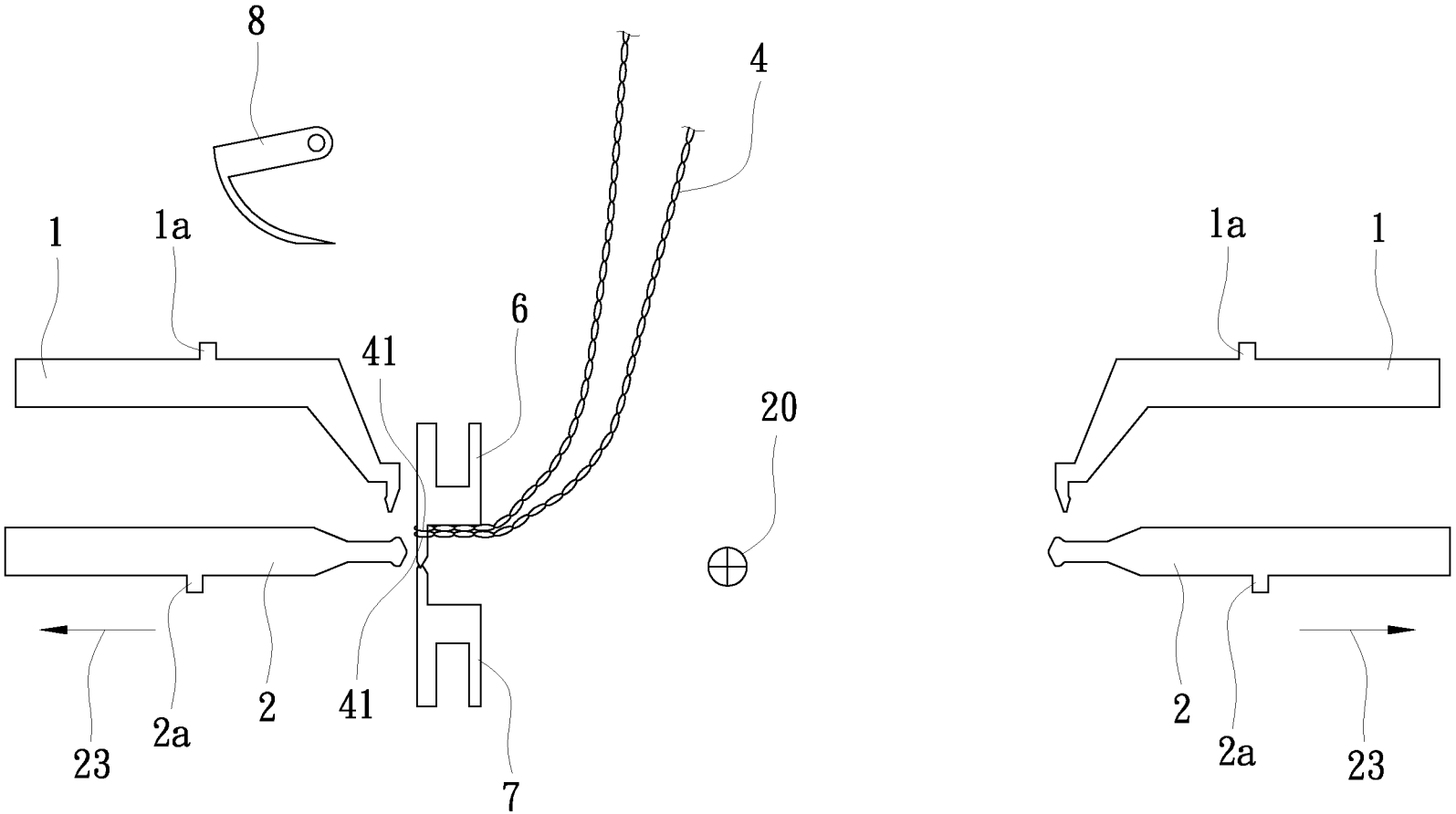
FIG. 21 shows the strip member being moved away from the reed.
Figure 22:
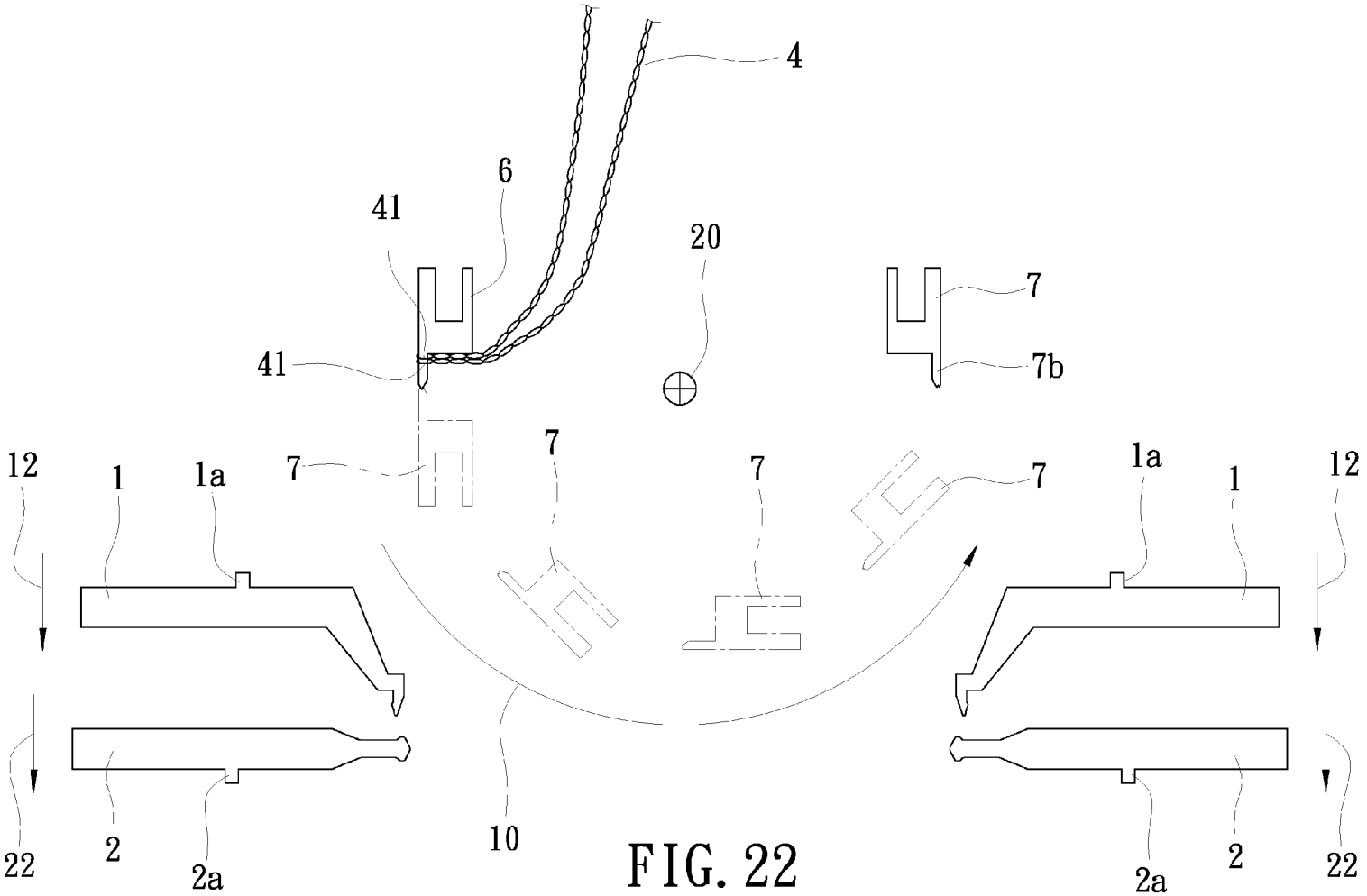
FIG. 22 shows the female reed section pivoting away from the male reed section.

As shown in FIG. 21, the transfer of the loop (41) from the female reed tooth (7) to the male reed tooth (6) has now been completed, and the strip members (2) are opened and moved away from the reed teeth (6, 7). Then, as shown in FIG. 22, the transfer and strip members (1, 2) are moved downward, thereby forming the clearance required for the return of the female reed tooth (7), and thus the female reed section (26), back to its original position. The female reed section (26) rotates back along an axis (20) to form the circular toe stitching apparatus (see FIG. 28) with the male reed section (25).

Figure 23:
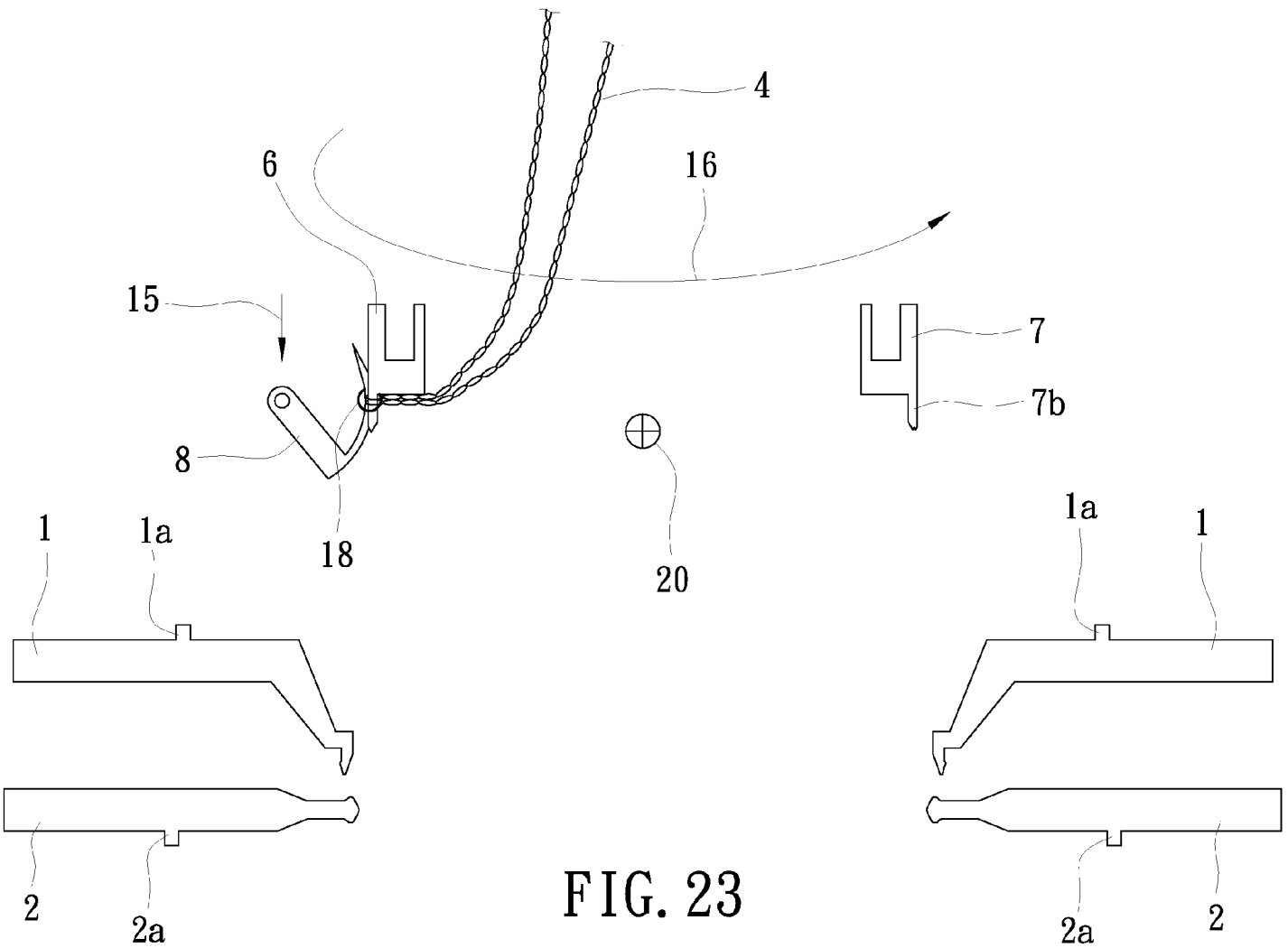
FIG. 23 shows the downward movement of a needle of a sewing machine to stitch together the loops on the tooth of the male reed section.

As shown in FIGS. 23 and 30, a needle (8) of a stitching machine, which is currently waiting in a position above the toe stitching apparatus, moves downward in the direction of an arrow (15). The needle (8) enters the channel (6*b*) in the direction of an arrow (27), and starts to stitch together the two loops (41). The loops (41) present on all the reed teeth (6) are individually stitched in the direction of an arrow (16), thereby completing the stitching process for closing the open-end or toe section of the stocking (4).

Figure 24:
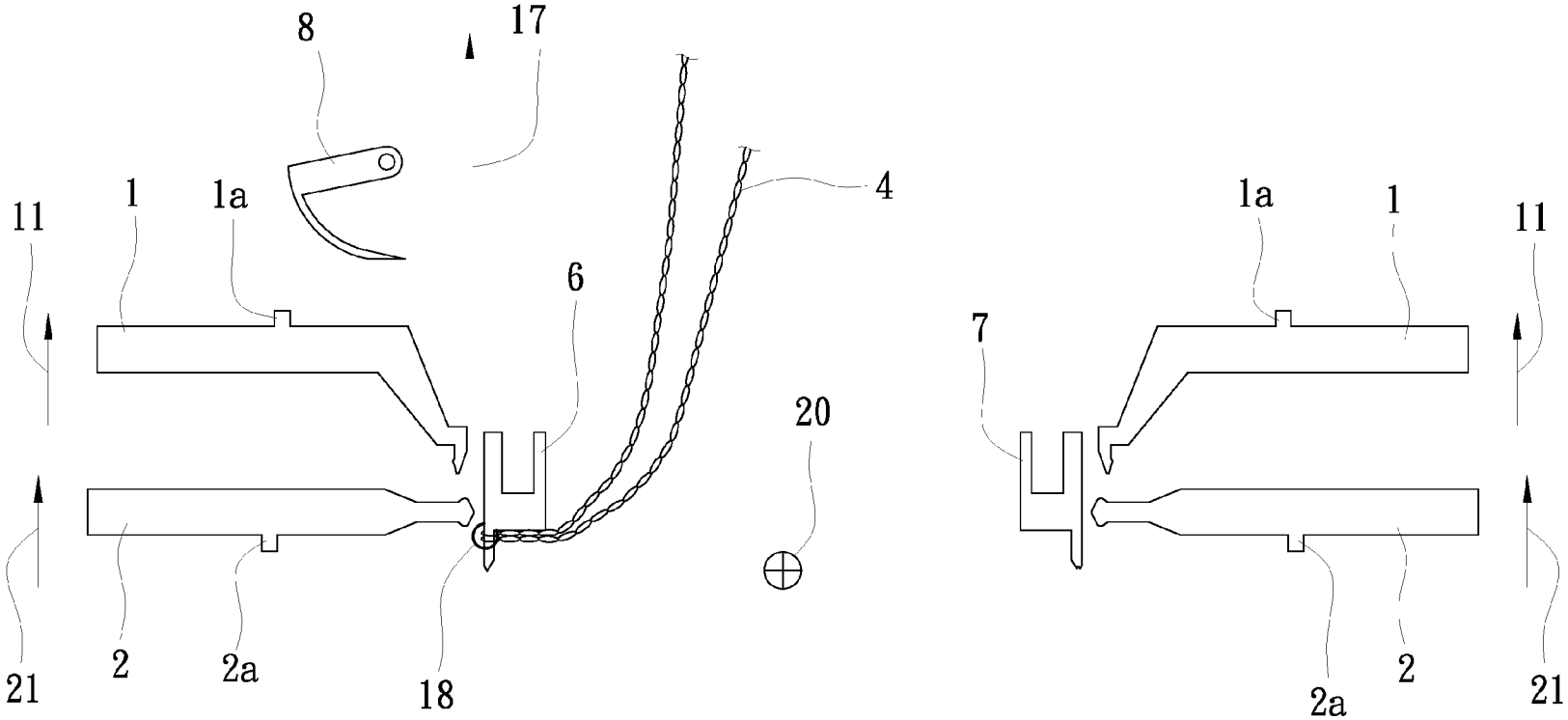
FIG. 24 shows the needle of the sewing machine being moved away from the male reed section once the stitching has been completed, and the upward movement of the transfer and strip members.
Figure 25:
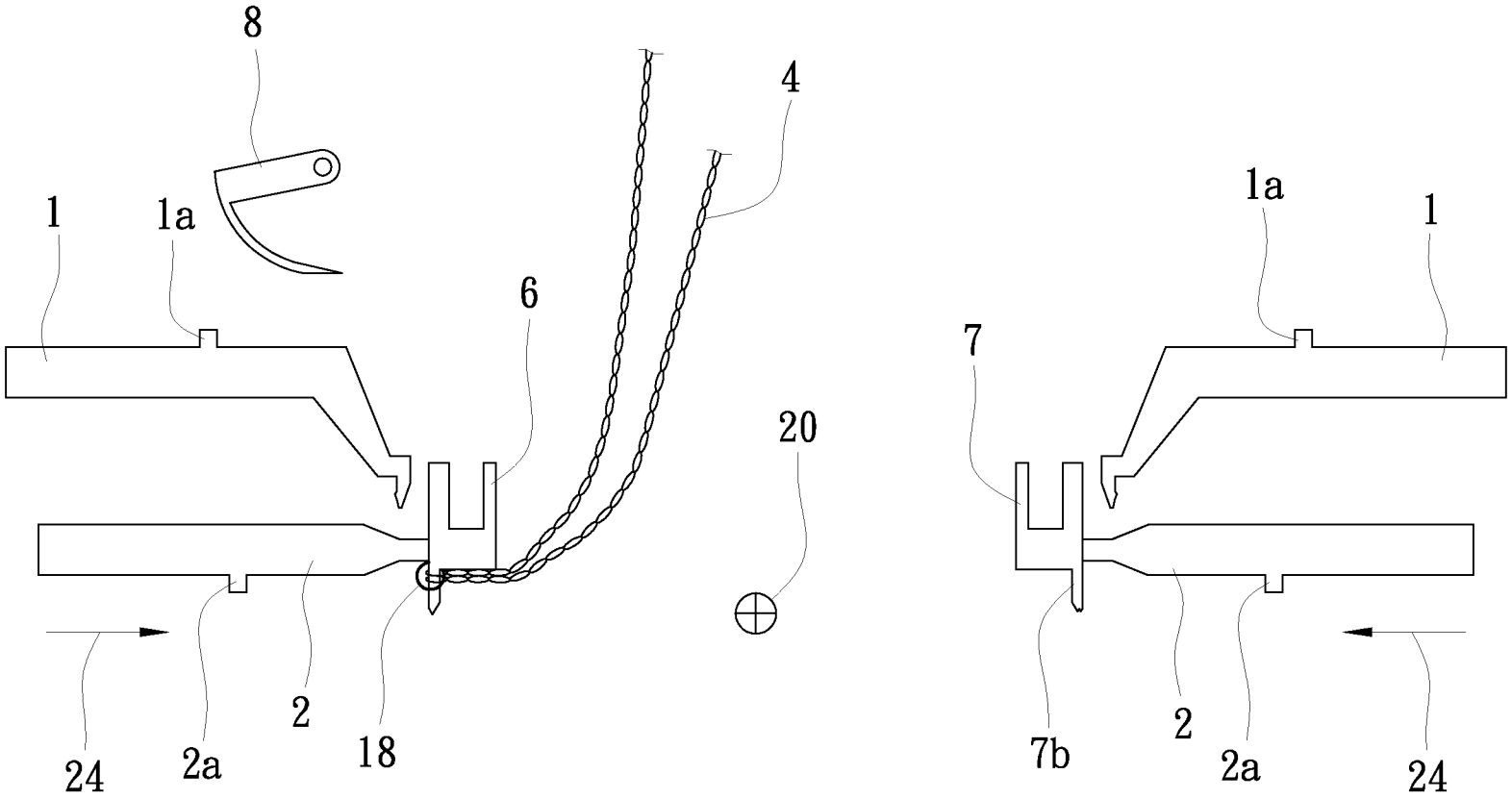
FIG. 25 shows the movement of the strip member to the male reed section.

After completing the stitching process, the stitching machine, which is represented by the needle (8) in FIG. 24, is moved upward in the direction of an arrow (17), and the transfer and strip members (1, 2) are also moved upward simultaneously. The upward movement of the transfer and strip members (1, 2) are stopped when the left strip member (2) reaches a position in alignment with the gap (19) (see FIG. 28) between two male reed teeth (6), as shown in FIG. 24. Then, as shown in FIG. 25, the strip member (2) enters the gap (19) between the reed teeth (6).

Figure 26:
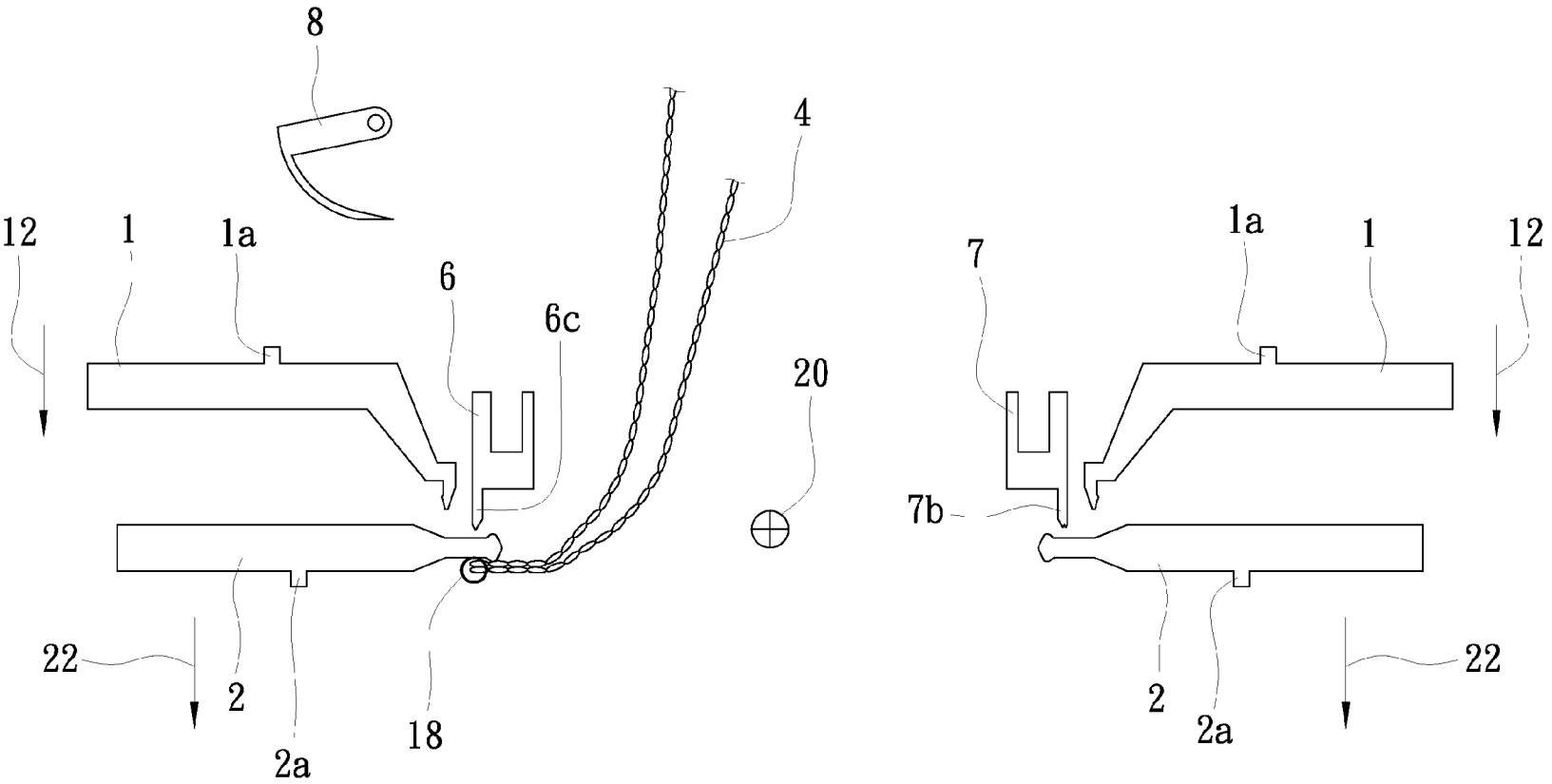
FIG. 26 shows the release of the loops from the male reed section through a downward movement of the strip and transfer members.

As shown in FIG. 26, the transfer and strip members (1, 2) are then moved downward to strip and move the stitch (18) of the toe of the stocking (4) away from the reed teeth (6).

Figure 27:
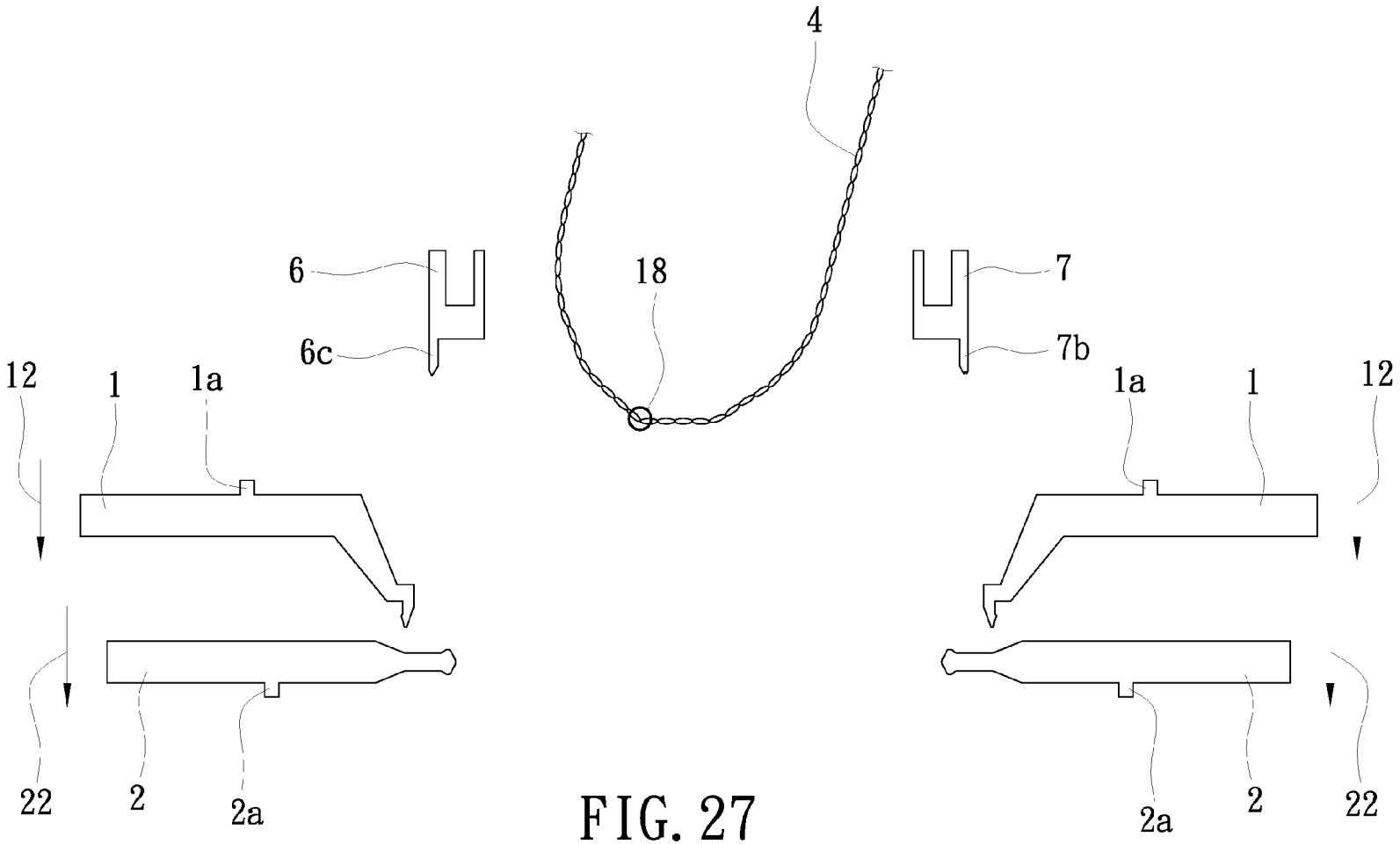
FIG. 27 shows a downward movement of the transfer and strip members to prepare for the transfer operation of the next stocking.

As shown in FIG. 27, the toe of the stocking (4) has now been closed through the stitch (18), and is released from the stitching apparatus. Then, the transfer and strip members (1, 2) prepare for the next stocking (4) by moving downward.

Figure 43:
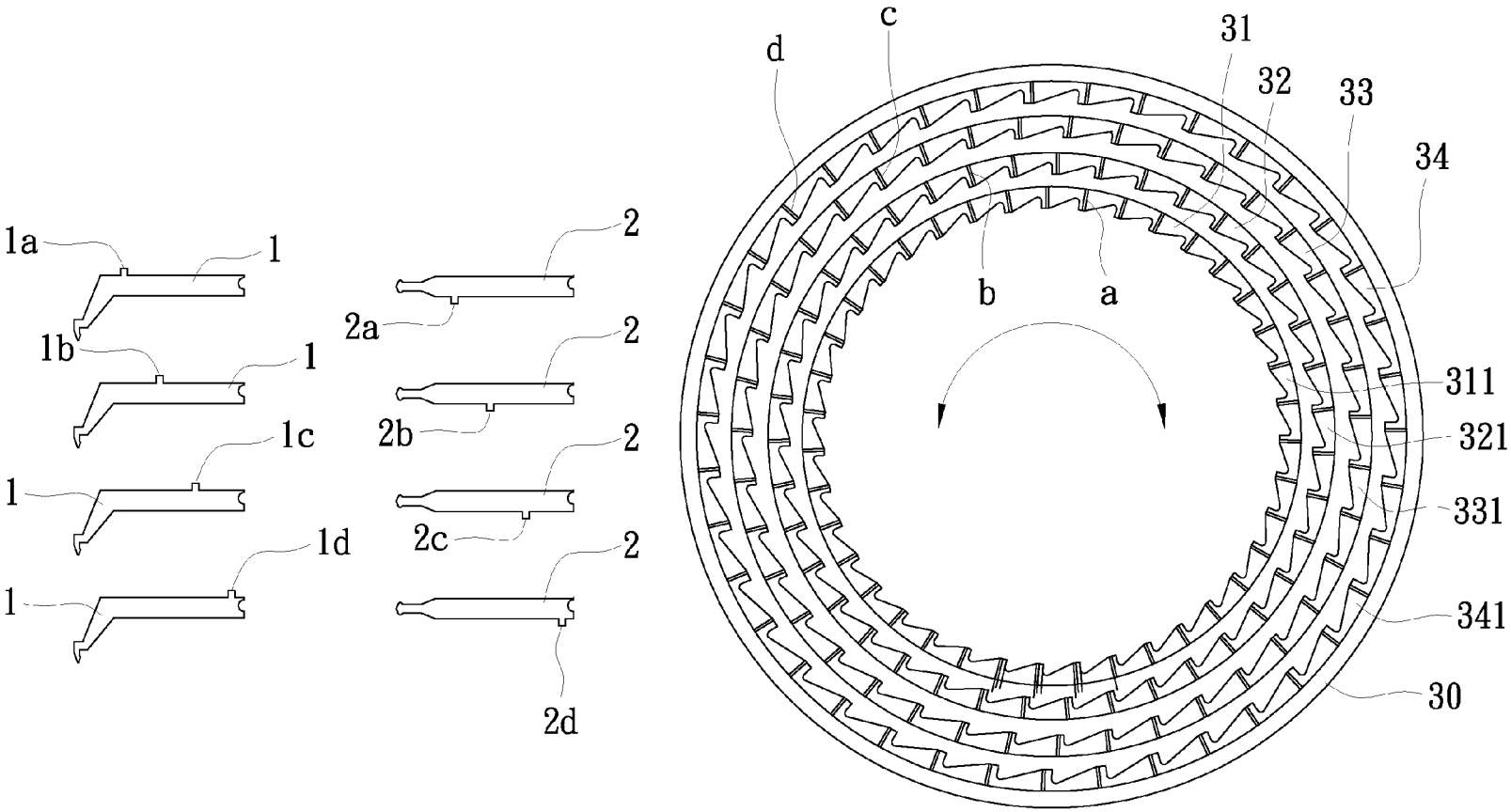
FIG. 43 shows the tail structures of the transfer and strip members of the transfer apparatus, and a cam mechanism for forward and backward radial movements of the transfer and strip members.
Figure 44:
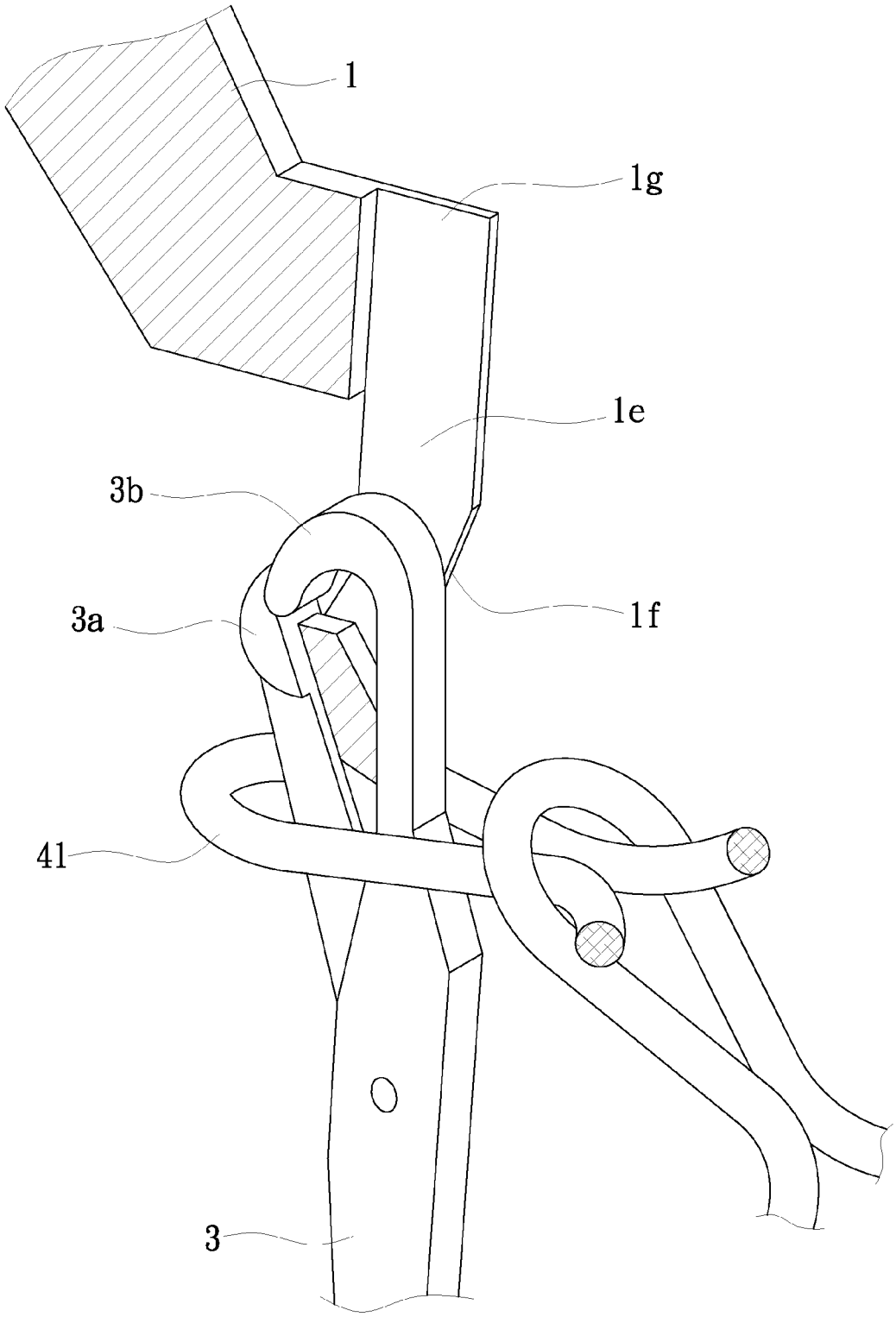
FIG. 44 shows the cross-section of the transfer member and the position thereof inside the hook.
Figure 45:
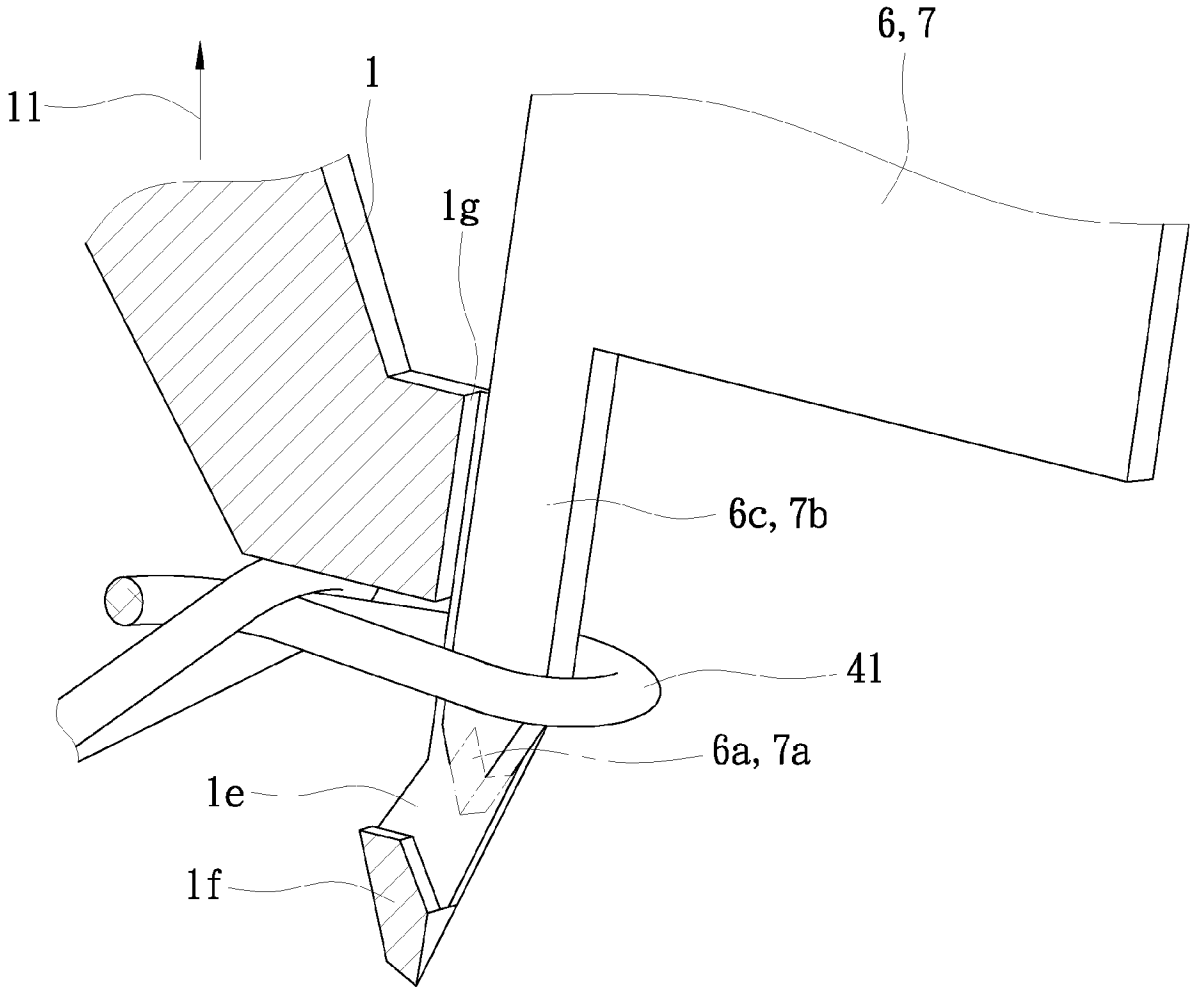
FIG. 45 shows the cross-section of the transfer member and how it moves into the tooth of the reed.
Figure 46:
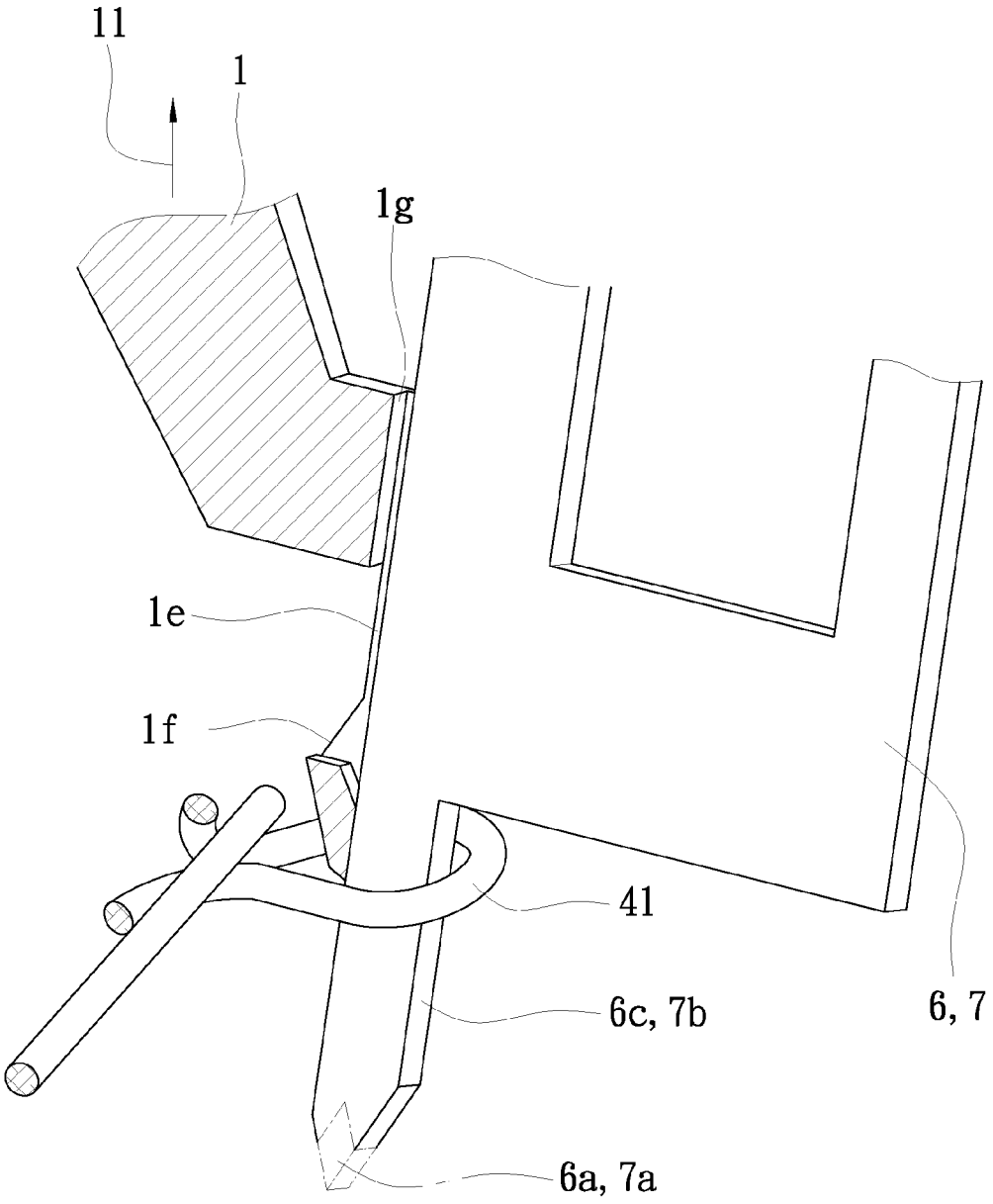
FIG. 46 is a view similar to FIG. 45, but illustrating how an upward movement of the transfer member results in the transfer of the loop to the tooth of the reed.

Although it is possible to actuate the transfer members (1) and the strip members (2) in the apparatus (100) according to the invention through any drive mechanism, the opening-closing (forward-backward) movement of the transfer and strip members (1, 2) are preferably actuated through a cam mechanism (30) shown in FIG. 43. The cam mechanism (30) has a plurality of cam rings (31, 32, 33, 34) of different diameters, which are disposed one around the other over the strip member bearing (28) and which are capable of performing circular rotation. Each cam ring (31, 32, 33, 34) has a plurality of circularly arranged cams (311, 321, 331, 341). Another cam mechanism of similar structure as that of the cam mechanism (30) has cam rings (31, 32, 33, 34) disposed over the transfer member bearing (29).

With reference to FIG. 43, because each cam mechanism (30) is positioned on the respective bearing (28, 29) such that each cam (311, 321, 331, 341) is in contact with the corresponding tail (1*a*, 1*b*, 1*c*, 1*d*, 2*a*, 2*b*, 2*c*, 2*d*), when the cam mechanism (30) rotates to a certain extent, the transfer members (1) and the strip members (2) can simultaneously move radially forward/backward to the same extent. The arrangement of the tails (1*a*, 1*b*, 1*c*, 1*d*) on the transfer members (6) is staggered. The arrangement of the tails (2*a*, 2*b*, 2*c*, 2*d*) on the strip members (7) is also staggered. The transfer member tails (1*a*, 1*b*, 1*c*, 1*d*) respectively engage channels (a, b, c, d) formed in the cams (31, 32, 33, 34) of the cam mechanism (30) and, likewise, the strip member tails (2*a*, 2*b*, 2*c*, 2*d*) respectively fit into channels (a, b, c, d) in the other cam mechanism. Of course, this example simplifies the mechanism. The number of such channels (a, b, c, d) in the cam mechanism (30) is the same as the number of the transfer members (1) or the number of the strip members (2). Although preferably four separate tails (1*a*, 1*b*, 1*c* and 1*d* or 2*a*, 2*b*, 2*c*, 2*d*) have been contemplated above, the number of tails (1*a*, 1*b*, 1*c*, 1*d* or 2*a*, 2*b*, 2*c*, 2*d*) could be less or more than four. Accordingly, the number of cams (311, 321, 331, 341) present in the cam mechanism (30) actuating the transfer members (1) and the strip members (2) will also vary.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A transfer apparatus for transferring a stocking from a knitting machine to a stitching apparatus to close an open-end of the stocking, the knitting machine including a needle extending vertically and axially and having a hook for forming a loop at the open-end of the stocking, and a latch that is pivotal upward and downward to move to or away from the hook, said transfer apparatus comprising:

a strip member extending horizontally and movable axially upward and downward and radially towards and away from the needle, said strip member contacting the loop on the needle when moved toward the needle to push the loop toward or away from the hook of the needle; and a transfer member disposed horizontally above said strip member and movable axially upward and downward and radially toward and away from the needle, said transfer member including a tip region for receiving the loop from the hook of the needle when said strip member pushes the loop to the hook.

2. The transfer apparatus according to claim 1, wherein said tip region has a front tip that is hollow and that has a front opening adapted to face the needle and for insertion of the needle.

3. A transfer apparatus for transferring a stocking from a knitting machine to a stitching apparatus to close an open-end of the stocking, the knitting machine including a needle extending vertically and axially and having a hook for forming a loop at the open-end of the stocking, and a latch that is pivotal upward and downward to move to or away from the hook, said transfer apparatus comprising:

a strip member extending horizontally and movable axially upward and downward and radially toward and away from the needle, said strip member contacting the loop on the needle when moved toward the needle to push the loop toward or away from the hook of the needle; and a transfer member disposed horizontally above said strip member and movable axially upward and downward and radially toward and away from the needle, said transfer member including a tip region for receiving the loop from the hook of the needle when said strip member pushes the loop to the hook;

wherein said tip region has a front tip that is hollow and that has a front opening adapted to face the needle and for insertion of the needle; and wherein said transfer member further includes a radial shank portion, said tip region extending inclinedly and downward from said shank portion to said front tip and bending radially and thereafter axially and downward at said front tip.

4. The transfer apparatus according to claim 3, wherein said front opening is disposed at a location where said tip region bends axially and downward to face the needle.

5. The transfer apparatus according to claim 4, wherein said front tip further has a top opening at a location where said tip region bends radially, said top opening being communicated with said front opening and being adapted for insertion of a tooth of a reed of the stitching apparatus.

6. The transfer apparatus according to claim 3, further comprising a strip member bearing having radial channels that are spaced annularly, a plurality of said strip members being disposed slidably and respectively in said radial channels of said strip member bearing.

7. The transfer apparatus according to claim 6, further comprising a transfer member bearing having radial channels that are spaced annularly, a plurality of said transfer members being disposed slidably and respectively in said radial channels of said transfer member bearing.

8. The transfer apparatus according to claim 7, further comprising a cam mechanism having a plurality of cam rings of different diameters, which are disposed one around the other over said strip member bearing and each of which has a plurality of circularly arranged cams, each of said strip members having an axially protruding tail cammed by one of said cams to move radially forward or backward.

9. The transfer apparatus according to claim 8, further comprising another cam mechanism having a plurality of cam rings of different diameters, which are disposed one around the other over said transfer member bearing and each of which has a plurality of circularly arranged cams, each of said transfer members having an axially protruding tail cammed by one of said cams of said another cam mechanism to move radially forward or backward.

10. A method for transferring an open-end of a stocking from a knitting machine to a stitching apparatus, the knitting machine including a needle, which extends vertically and axially and which has a hook to form a loop at the open-end of the stocking, and a latch that is pivotal upward and downward to move to or away from the hook, the method comprising:

moving a strip member towards the needle to contact the loop on the needle from above and to slide downward the loop from the hook of the needle until the loop passes the latch;

moving the strip member away from the needle after the loop has passed the latch of the needle;

moving the strip member toward the needle once again to contact the loop from below and to slide the loop upward and toward the hook;

moving a transfer member disposed above the strip member until the transfer member reaches the hook and until the hook is inserted into a tip region of the transfer member; and moving the strip member further upward to push and transfer the loop from the hook to the transfer member.

11. The method of claim 10, further comprising the step of moving the strip and transfer members simultaneously away from the needle while the strip member is still in contact with the loop from below to thereby stabilize the loop on the transfer member.

12. The method of claim 10, wherein each of the strip and transfer members extends radially and horizontally, and is movable axially upward and downward and radially toward or away from the needle.

13. The method of claim 10, wherein the transfer member has a front tip that is hollow and that has a front opening facing the needle, the needle extending into the front opening when the transfer member moves forward to the needle.

14. The method of claim 10, further comprising:

moving upward the strip and transfer members together with the loop until the transfer member reaches a reed of the stitching apparatus and permits a tooth of the reed to extend into the tip region of the transfer member;

moving the transfer member away from the tooth to leave the loop on the tooth while the strip member is still intact; and moving the strip member away from the tooth after the loop is left on the tooth.

15. The method of claim 14, wherein the transfer member has a front tip that is hollow and that has a top opening, the tooth extending into the top opening when the transfer member reaches the reed.

16. The method of claim 10, wherein a plurality of said strip members and a plurality of said transfer members are used to transfer loops formed at the open-end of the stocking, the reed of the stitching apparatus including a male reed section having a male reed tooth, and a female reed section having a female reed tooth, the reed being collapsible to dispose the male and female reed sections one over the other and to align vertically the male reed tooth with the female reed tooth, the method further comprising:

moving upward the strip and transfer members together with the respective loops until the transfer members reach the reed and permit the respective male and female reed teeth to extend into the transfer members, respectively;

moving the strip members and the transfer members to transfer the loops from the transfer members to the respective male and female reed teeth;

collapsing the reed while the strip and transfer members are moved away from the reed so that the male reed tooth is aligned vertically with the female reed tooth; and moving one of the strip members to push upward and transfer the loop on a lower one of the male and female reed teeth to an upper one of the male and female reed teeth so that the loops on the aligned male and female reed teeth are juxtaposed for stitching.

17. The method of claim 16, wherein the transfer members are disposed slidably and respectively in annularly spaced-apart radial channels of a transfer member bearing.

18. The method of claim 17, wherein the strip members are disposed slidably and respectively in annularly spaced-apart radial channels of a strip member bearing.

19. The method of claim 18, wherein each of the strip members is movable to and away from the needle through a cam mechanism which has a plurality of cam rings of different diameters, the cam rings being disposed one around the other over said strip member bearing and each of which has a plurality of circularly arranged cams, each of the strip members having an axially protruding tail cammed by one of said cams to move radially forward or backward.

20. The method of claim 19, wherein each of the transfer members is movable to and away from the needle through another cam mechanism which has a plurality of cam rings of different diameters, the cam rings being disposed one around the other over said transfer member bearing and each of which has a plurality of circularly arranged cams, each of said transfer members having an axially protruding tail cammed by one of said cams of said another cam mechanism to move radially forward or backward.

* * * * *